US011396390B2

(12) United States Patent
Hiramoto et al.

(10) Patent No.: US 11,396,390 B2
(45) Date of Patent: Jul. 26, 2022

(54) FILLING APPARATUS

(71) Applicant: HOSOKAWA YOKO CO., LTD., Tokyo (JP)

(72) Inventors: Shinichi Hiramoto, Tokyo (JP); Hiroyuki Miyoshi, Tokyo (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 276 days.

(21) Appl. No.: 16/449,299

(22) Filed: Jun. 21, 2019

(65) Prior Publication Data

US 2020/0002031 A1 Jan. 2, 2020

(30) Foreign Application Priority Data

Jun. 27, 2018 (JP) ..... JP2018-122254

(51) Int. Cl.
*B65B 3/04* (2006.01)
*B65B 7/28* (2006.01)
(Continued)

(52) U.S. Cl.
CPC ..... *B65B 3/045* (2013.01); *B65B 7/2828* (2013.01); *B65B 43/14* (2013.01); *B65B 43/465* (2013.01)

(58) Field of Classification Search
CPC ..... B65B 3/045; B65B 7/2828; B65B 43/14; B65B 43/465; B65B 43/48; B65B 43/56;
(Continued)

(56) References Cited

U.S. PATENT DOCUMENTS 3,908,341 A * 9/1975 Conti ..... B67B 3/06 53/314
4,630,654 A * 12/1986 Kennedy, Jr. ..... B65B 3/28 141/128
(Continued)

FOREIGN PATENT DOCUMENTS

DE 19904165 A1 8/2000
JP 4-82734 A 3/1992
(Continued)

OTHER PUBLICATIONS

Japanese Office Action (JPOA) dated Apr. 25, 2022 for corresponding Japanese Patent Application No. 2018-122254 and its English machine translation.

*Primary Examiner* — Thomas M Wittenschlaeger
*Assistant Examiner* — Katie L Gerth
(74) *Attorney, Agent, or Firm* — Rankin, Hill & Clark LLP

(57) ABSTRACT

Provided is a filling apparatus including: a conveyor line configured to intermittently convey spout-equipped bags, which are suspended so that spouts protruding from one side of the spout-equipped bags, the bags being flat, are located on an upper side and the bags are located on a lower side, in a width direction of the suspended spout-equipped bags on a movement straight line; a printing apparatus disposed in the middle of the conveyor line and configured to print manufacturing information on the suspended spout-equipped bags; and nozzles configured to fill the suspended spout-equipped bags with a liquid material through the spouts. The conveyor line is further configured to convey the spout-equipped bags so that fronts of the spout-equipped bags directly face the printing apparatus.

12 Claims, 20 Drawing Sheets

(51) Int. Cl.
*B65B 43/14* (2006.01)
*B65B 43/46* (2006.01)

(58) Field of Classification Search
CPC ..... B65B 7/2835; B65B 43/12; B65B 43/44; B65B 7/025; B65B 61/26; B65B 61/025; B65B 43/54; B65B 57/145; B65B 43/123; B65B 3/17; B65B 3/28; B65B 3/16
See application file for complete search history.

(56) References Cited

U.S. PATENT DOCUMENTS 4,712,567 A * 12/1987 Gille ..... A61B 5/14507 600/573
6,338,371 B1 * 1/2002 Araki ..... B65B 43/465 141/129
6,430,896 B1 * 8/2002 Torikian ..... B65B 7/2835 53/310
6,575,289 B2 * 6/2003 Hiramoto ..... B65B 43/14 198/433
8,079,200 B2 * 12/2011 Tsutsui ..... B65B 57/02 53/133.1
9,340,309 B2 * 5/2016 Nakagawa ..... B65B 43/52
9,569,833 B2 2/2017 Heuft
10,589,885 B2 3/2020 Hashimoto et al.
2004/0011001 A1 * 1/2004 Hiramoto ..... B65B 9/093 53/133.2
2008/0313998 A1 12/2008 Ligon et al.
2010/0170591 A1 * 7/2010 Murray ..... B65G 47/61 141/1
2011/0017343 A1 * 1/2011 Murray ..... B65B 3/045 141/1
2013/0286123 A1 * 10/2013 Olejniczak ..... B41J 3/407 347/104
2014/0075896 A1 * 3/2014 Albert ..... B65B 43/44 53/571
2014/0157731 A1 * 6/2014 Perazzo ..... B65B 5/045 53/473
2015/0010229 A1 1/2015 Heuft
2016/0122057 A1 * 5/2016 Takahashi ..... B65B 43/465 53/284.7
2017/0008651 A1 * 1/2017 Lizari Illarramendi ..... B65B 7/2835
2018/0079542 A1 3/2018 Hashimoto et al.
2020/0031505 A1 * 1/2020 Sugiura ..... B65B 43/36

FOREIGN PATENT DOCUMENTS

JP 11-314602 A 11/1999
JP 2001328601 A2 11/2001
JP 2002-2945 A 1/2002
JP 2002-536265 A 10/2002
JP 2005059928 A 3/2005
JP 2015-509469 A 3/2015
JP 2016-64867 A 4/2016
JP 2016-175725 A 10/2016
JP 2017-6826 A 1/2017
WO 2012/006980 A2 1/2012

* cited by examiner

FILLING APPARATUS

CROSS-REFERENCE TO RELATED APPLICATION

This application claims priority from Japanese Patent Application No. 2018-122254 filed with the Japan Patent Office on Jun. 27, 2018, the entire content of which is hereby incorporated by reference.

BACKGROUND

1. Technical Field

The present disclosure relates to a spout-equipped bag filling apparatus.

2. Related Art

A filling apparatus for filling the spout-equipped bag with liquid or a viscous body of, for example, a liquid beverage such as a soft drink, food, medicine, or detergent is known.

A spout of the spout-equipped bag is a pouring outlet at the time of opening. The spout-equipped bag is a packaging bag which enables a user to ingest or use the contents of the liquid or viscous body of the liquid beverage such as a soft drink, food, or medicine when needed. For example, the following packaging bags are known as examples of the spout-equipped bags. In the spout-equipped bag, a gusset film is folded inward from both sides of a front and back pair of exterior films. A peripheral edge portion of the gusset film is heat sealed to the exterior films. Further, the spout is attached to upper and lower edges of the exterior film. By the spout, a mouth which is the pouring outlet for the bag heat-sealed mutually can be opened or closed with a plug such as a screw cap.

For example, JP-A-2005-59928 discloses a bag formed of a composite material including an aluminum foil and a synthetic resin film that are laminated. Here, the spout protrudes by a predetermined length from a central portion of an upper side of the bag.

When such a spout-equipped bag is filled with, for example, a liquid material such as a soft drink, for example, a filling apparatus shown in JP-A-2001-328601 is used. The filling apparatus disclosed in JP-A-2001-328601 includes a bag holding member for holding the packaging bag at predetermined intervals in a circumferential direction on a turntable rotating intermittently. Then, with rotation of the turntable, a plurality of steps arranged in the circumferential direction of the turntable are sequentially performed. Examples of the steps includes a step of setting the packaging bag in the bag holding member, a step of printing a date of manufacture or the like, a step of filling the bag with the liquid material using a nozzle, a step of cleaning the outside of the mouth of the spout, a step of attaching the screw cap, and checking tightening of the screw cap.

With the filling apparatus of JP-A-2001-328601, all the steps are concentrated around the turntable. Then, all the steps are completed while going around the turntable. Further, when a small spout of a relatively small-capacity packaging bag is handled in each step, the turntable can be rotated while holding the spout by the bag holding member. This also has an advantage that position accuracy of the spout can be ensured.

SUMMARY

According to one embodiment of the present disclosure, a filling apparatus includes: a conveyor line configured to intermittently convey spout-equipped bags, which are suspended so that spouts protruding from one side of the spout-equipped bags, the bags being flat, are located on an upper side and the bags are located on a lower side, in a width direction of the suspended spout-equipped bags on a movement straight line; a printing apparatus disposed in the middle of the conveyor line and configured to print manufacturing information on the suspended spout-equipped bags; and nozzles configured to fill the suspended spout-equipped bags with a liquid material through the spouts. The conveyor line is further configured to convey the spout-equipped bags so that fronts of the spout-equipped bags directly face the printing apparatus.

BRIEF DESCRIPTION OF THE DRAWINGS

FIG. 1A is a front view;

FIG. 1B is a side view;

FIG. 1C is a perspective view;

FIG. 1D shows a neck of a spout-equipped bag of another mode;

FIG. 1E shows a cross-section of the neck;

FIG. 1F shows a magazine;

FIG. 4A shows overlap of a multi-hook and hold bars;

FIGS. 4I to 4N show a relationship between the multi-hook and the neck with respect to the hold bars;

FIGS. 10A to 10D are diagrams showing a modification of a screw cap supply apparatus and the like;

FIG. 11A is a perspective view;

FIG. 11B is a diagram for explaining a movement;

DETAILED DESCRIPTION

Figure 1A:
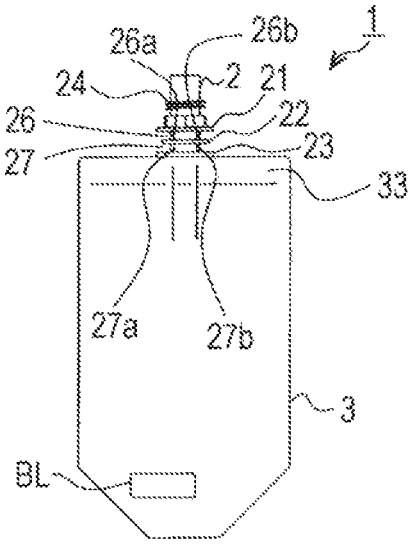
FIGS. 1A to 1F show a spout-equipped bag 1.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to JP-A-2001-328601, when operations such as filling and screw cap tightening are performed, a spout-equipped bag is held by a bag holding member of a turntable. In intermittent conveyance using the turntable, the spout-equipped bag rotates in its width direction. Therefore, centrifugal force acts in a thickness direction of the bag. Therefore, the spout-equipped bag swings a lot. In such a case, when printing manufacturing information such as a best-before date, an interval between a head of a printing apparatus and the spout-equipped bag is not stable. Therefore, control of print quality is difficult. Further, when measuring a weight, if the spout-equipped bag is swinging in a radial direction, measurement accuracy is degraded. On the other hand, if the weight is measured after waiting for swinging to stop, production efficiency per unit time falls.

Further, in JP-A-2001-328601, two juxtaposed spout-equipped bags to be processed are processed. Apparatuses for performing each step always only from the outer peripheral side are arranged around the turntable. Further, the same steps are arranged side by side in parallel processing. There is a limit to a space in which the apparatuses can be placed around the turntable. Adding more apparatuses is difficult. Further, when unloading the spout-equipped bag after the steps are completed, the bag can only be unloaded toward the outer peripheral side. There is a waste of installation space in a factory machine layout. Furthermore, the holding member of the turntable unloads the filled spout-equipped bag and then receives an empty spout-equipped bag. Therefore, dirt scattered in a cleaning step accumulates directly on the holding member to contaminate a new spout-equipped bag.

The filling apparatus according to one embodiment of the present disclosure has been developed in view of the above-described conventional problems. An object of the present disclosure is to provide the filling apparatus that can stably convey the spout-equipped bag by reducing the swinging of the spout-equipped bag intermittently conveyed in the filling machine. This filling apparatus can reduce time required for stationary and improve the production efficiency.

According to one embodiment of the present disclosure, a filling apparatus includes: a conveyor line configured to intermittently convey spout-equipped bags, which are suspended so that spouts protruding from one side of the spout-equipped bags, the bags being flat, are located on an upper side and the bags are located on a lower side, in a width direction of the suspended spout-equipped bags on a movement straight line; a printing apparatus disposed in the middle of the conveyor line and configured to print manufacturing information on the suspended spout-equipped bags; and nozzles configured to fill the suspended spout-equipped bags with a liquid material through the spouts. The conveyor line is further configured to convey the spout-equipped bags so that fronts of the spout-equipped bags directly face the printing apparatus.

According to the present embodiment, a conveying direction by the conveyor line is linear. Therefore, even if a filling process is multiplexed or complicated, it can be handled by merely changing a length of the conveyor line. Therefore, expansion of each processing apparatus is easy. Further, a final end of the conveyor line is open. Therefore, when the spout-equipped bag is unloaded after the steps are completed, the spout-equipped bag can be unloaded in either direction.

According to the present embodiment, the spout-equipped bag is conveyed in the width direction of the bag on at least a part of the conveyor line. Therefore, the front of the spout-equipped bag directly faces the printing apparatus. Thus, the swinging of the spout-equipped bag conveyed is small. Thus, the interval between the spout-equipped bag and the printing apparatus is stable. Therefore, variation of character quality of printing is suppressed. In addition, the interval between the spout-equipped bag and the camera is also stable. Therefore, disturbance of a captured image is also small.

According to the present embodiment, a multi-hook only reciprocates a predetermined distance. Therefore, there is an effect that contamination is not moved upstream of the conveyor line. Further, the motion of the spout-equipped bag is linear. Therefore, operation management is easier. There is an effect that the swinging due to the centrifugal force is small, and further the spout-equipped bag can be stably conveyed.

Figure 1B:
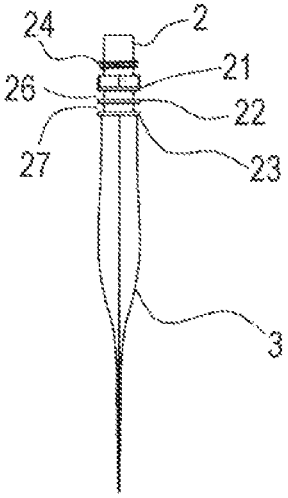
Figure 1C:
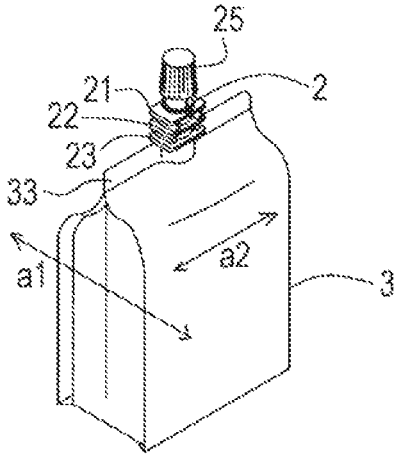
Figure 1D:
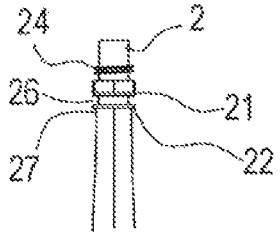
Figure 1E:
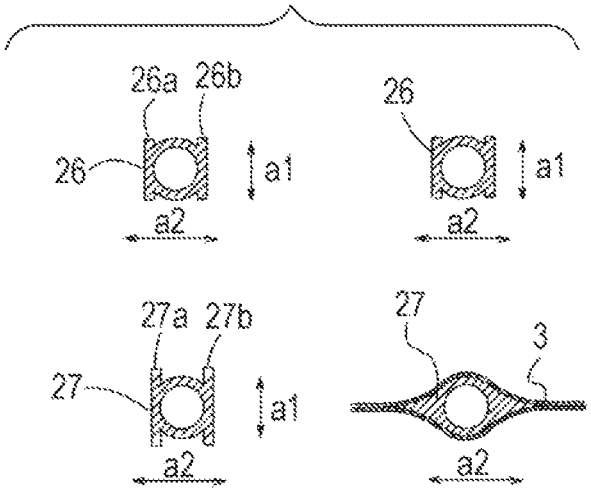
Figure 1F:
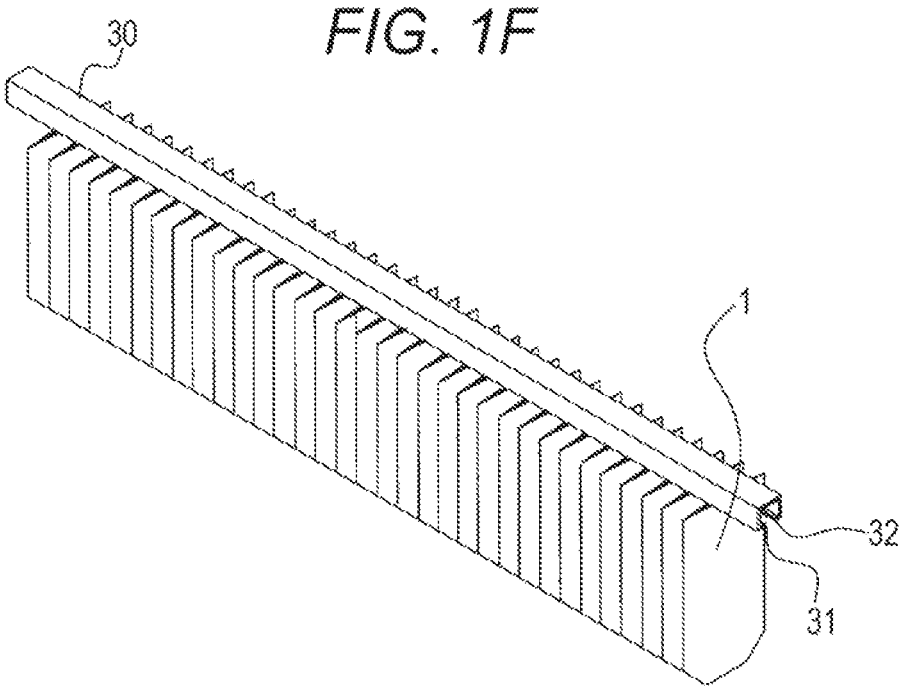

A specific embodiment of the present disclosure will be described with reference to the drawings below. FIG. 1A-F show a spout-equipped bag 1. FIG. 1A is a front view. FIG. 1B is a side view. FIG. 1C is a perspective view. Before the filling, the spout-equipped bag 1 is folded to be substantially flat. A spout 2 protrudes from an upper side of the bag 3 on an extension of a plane of the bag. In the present Example, the thickness direction of the bag 3 is defined as a "thickness direction a1 of the bag 3". A direction perpendicular to a longitudinal direction of the spout 2 and the thickness direction a1 of the bag 3 is defined as a "width direction a2 of the bag 3". In a portion of the spout 2 protruding from the bag 3, three radially extending flanges 21, 22, and 23 are arranged at predetermined positions in order from the top. The lowermost flange 23 is at a position of an upper end of the bag 3. The flange 23 positions the spout 2 and the bag 3. On the upper side of an uppermost flange 21, a male screw 24 with which a screw cap 25 is screwed is provided. When the spout-equipped bag 1 is handled, end edges 31 and 32 of a rail-like magazine 30 of C-shaped cross-section generally fit onto a neck 26 formed between the uppermost flange 21 and a middle flange 22 of the spout 2 of the spout-equipped bag (see FIG. 1F). FIG. 1F shows a typical delivery form from a bag manufacturer. FIG. 1D is the neck of another form of spout-equipped bag 1. This spout-equipped bag 1 has two flanges 21 and 22. Besides this, it is also possible to use a type of spout with only one flange. Description of this type of spout will be omitted.

The neck 26 can have various cross-sections. The bag 3 has opposite sides 26*a* and 26*b* parallel to each other in the thickness direction a1. Further, the opposite sides 26*a* and 26*b* have the same length. The cross-section of the neck 26 has a shape inscribed in a rectangle having a pair of opposite sides respectively parallel to the thickness direction a1 and the width direction a2 of the bag 3. An upper edge seal portion 33 bonds upper edges of the bag 3 to each other. The upper edge seal portion 33 also bonds the spout 2 and the bag 3. The opposite sides 26*a* and 26*b* of the neck 26 abut the end edges 31 and 32 of the magazine 30. Thus, the spout-equipped bag 1 can be aligned in the same direction with respect to the magazine 30. In addition to the neck 26 between the uppermost flange 21 and the middle flange 22, a neck 27 is also provided between the middle flange 22 and the lowermost flange 23. The neck 27 also has opposite sides 27*a* and 27*b* parallel to the thickness direction a1 of the bag 3. Moreover, the opposite sides 27*a* and 27*b* have the same length. FIG. 1E shows cross-sectional shapes of the necks 26 and 27 of FIG. 1B, on the upper left side and lower left side of FIG. 1E. Further, FIG. 1E shows the cross-sectional shapes of the necks 26 and 27 of FIG. 1D, on the upper right side and lower right side of FIG. 1E. These cross-sectional shapes often differ from each other. However, these cross-sectional shapes are common in that they are inscribed in the rectangle having the pair of opposite sides respectively parallel to the thickness direction a1 and the width direction a2 of the bag 3. The neck 26 below the flange 21 shown on the left side in FIG. 1E is the same as the neck 26 shown on the right side. However, the neck 27 below the flange 22 shown on the right side of FIG. 1E is a bonding portion in which the bag 3 and the spout 2 are adhered to each other in an airtight and watertight manner. This neck 27 has a gentle cross-section.

Example 1

Figure 2:
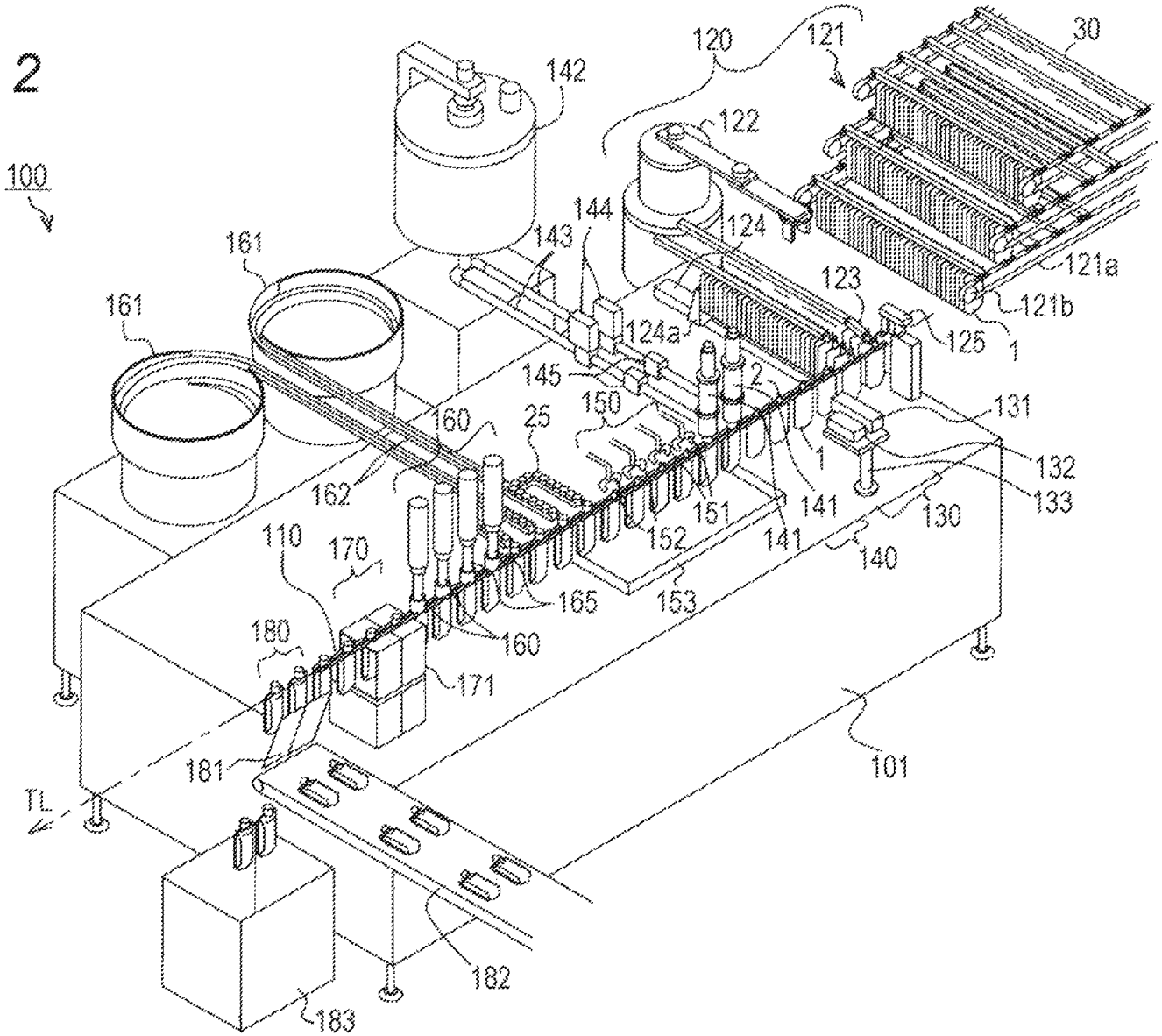
FIG. 2 is a perspective view showing a schematic structure of a filling apparatus according to Example 1.

FIG. 2 is a perspective view showing a schematic structure of a filling apparatus 100 according to Example 1. The filling apparatus 100 has a machine base 101 provided with a conveyor line 110 which intermittently conveys the spout-equipped bag 1 on a movement straight line TL (indicated by a one-dot chain line). The movement straight line TL refers to an imaginary line extending in the direction in which the spout-equipped bag 1 is conveyed. In no case the movement straight line TL represents any specific section or range. The spout-equipped bag 1 is suspended such that the spout 2 is positioned above the bag 3 in a posture in which the width direction a2 of the bag 3 is along the movement straight line TL while being conveyed. The conveyor line 110 conveys the spout-equipped bag 1 from right to left in the figure as indicated by an arrow in the figure. Details of the structure of the conveyor line 110 will be described below.

A bag supply apparatus 120 provided at the uppermost stream of the conveyor line 110 supplies the spout-equipped bag 1 onto the conveyor line 110. In the present Example, the two juxtaposed spout-equipped bags 1 are supplied from the bag supply apparatus 120 to the conveyor line 110. The conveyor line 110 performs the intermittent conveyance including a repetition of movement of conveying the two spout-equipped bags 1 to a next step and stopping the movement. In each step, the two juxtaposed spout-equipped bags 1 are processed. Therefore, in each step except printing/inspection, two working devices are arranged side by side.

In the printing and inspection step 130, the manufacturing information (manufacturing factory number, manufacturing number, manufacturing date, best-before date, or the like) is printed on the front of the bag 3 (an area BL in FIG. 1A) by a printing apparatus 131 such as an ink jet printer. The spout-equipped bag 1 is conveyed on the conveyor line 110 in the width direction a2 of the bag 3. The spout-equipped bag 1 is conveyed along the conveyor line 110 so that the front of the bag 3 directly faces the head of the printing apparatus 131. When the printing apparatus 131 prints, for example, N×M dot characters, a vertical row including N dots is first printed. Then, the spout-equipped bag 1 is conveyed sideways by one dot. Then, a vertical row including the next N dots is printed. Such printing is repeated M times to print dot characters. Print results are inspected for the presence or absence of printing defects such as blurring or misalignment by imaging the print results by a camera 132. The camera 132 also directly faces the front of the spout-equipped bag 1 conveyed in the width direction a2 of the bag 3. The printing by the printing apparatus 131 and imaging by the camera 132 are performed on the spout-equipped bag 1 conveyed in the width direction a2 of the bag 3. Since the spout-equipped bag 1 is conveyed in the width direction a2 of the bag 3, the swinging due to conveyance of the spout-equipped bag 1 is small. That is, the upper edge seal portion 33 bonding the spout 2 and the bag 3 has high rigidity. Therefore, when the spout-equipped bag 1 is conveyed in the width direction a2 of the bag 3, the spout-equipped bag 1 conveyed is less likely to swing. In contrast, when the spout-equipped bag 1 is conveyed in the thickness direction a1 of the bag 3, the spout-equipped bag 1 easily swings around the sealed upper edge. The interval between the spout-equipped bag 1 and the printing apparatus 131 or the camera 132 is stable. Therefore, the variation of the character quality of the printing is suppressed. Further, the disturbance of the captured image is also suppressed. Moreover, two adjacent spout-equipped bags 1 can be simultaneously operated on the conveyor line 110 with a set of printing apparatus 131 and camera 132. Further, the printing apparatus 131 and the camera 132 are integrally installed as a printing-and-inspection unit 133. Therefore, change of installation position is easy. Further, information such as character density, size, and position is acquired by the camera 132. By feeding back this information to the printing apparatus 131, automatic control can be performed so that the printing on the spout-equipped bag 1 is always performed optimally.

In a filling step 140, a tip of a nozzle 141 is pressed against the spout 2 of the spout-equipped bag 1. In this way, the nozzle 141 and the spout-equipped bag 1 communicate with each other. Then, air in the bag 3 is once sucked out. Then, a predetermined amount of the liquid material (a filling object) is filled from a storage tank 142. Further, inert gas is replenished. A constant pressure is applied to the storage tank 142 so that the liquid material is pushed out toward the nozzle 141. An electromagnetic flow meter 144 for measuring a flow rate of the liquid material is inserted in the middle of a path 143 from the storage tank 142 to the nozzle 141. The electromagnetic flow meter 144 outputs the measured flow rate as the number of pulses. Further, a sensor 145 for detecting a temperature of the liquid material is provided in the middle of the path 143.

In the cleaning step 150, spraying of cleaning solution and air is performed. An outer surface of the spout 2 is cleaned. In the cleaning step 150, the spout-equipped bag 1 stops twice to perform cleaning by a nozzle 151 for blowing out the cleaning solution and drying by a nozzle 152 for blowing out the air. A liquid dish container 153 is provided below the conveyor line 110 from the filling step 140 to the cleaning step 150. Thus, scattering of the overflowing liquid material or the cleaning solution is suppressed.

In the sealing step 160, the screw cap 25 is attached to the spout-equipped bag 1 at three stop positions. In a first stop position, the screw cap 25 is supplied from a screw cap supply apparatus 161 to the spout-equipped bag 1. Two-system screw cap supply apparatuses 161 are provided in advance so that a size of the screw cap can be selected. In the next stop position, pre-tightening by a driver 165 is performed. In the pre-tightening, while the screw cap 25 is rotating for a predetermined amount or for a predetermined time, a female screw of the screw cap 25 is roughly screwed into the male screw 24 provided on the spout 2. After the pre-tightening, the spout-equipped bag 1 is fully tightened by a driver 166. In final tightening, the screw cap 25 further rotates to tighten the screw cap 25. If the pre-tightening and the final tightening are performed in one step, a range of idle rotation varies in a first rotation of the pre-tightening. Therefore, time of pre-tightening is not constant. As a result, it is necessary to keep a process time longer in order to secure the time for performing the final tightening. However, in the present Example, the pre-tightening and the final tightening are performed at different positions. Thus, the time with little variation which can be used for the final tightening can be secured. Therefore, the process time can be shortened.

In the weight measurement step 170, a weight of the filled spout-equipped bag is measured by a weighing scale 171. Thereafter, in an unloading step 180, the spout-equipped bag is unloaded to an unloading conveyor 182 by a sorting machine 181. Or, in the case of a defective product, the spout-equipped bag is collected in a collection box 183.

(Conveyor Line)

Figure 4A:
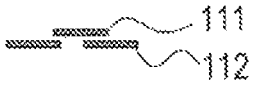
FIGS. 4A to 4N show details of a conveyor line.
Figures 4B, 4C, 4D, 4E:
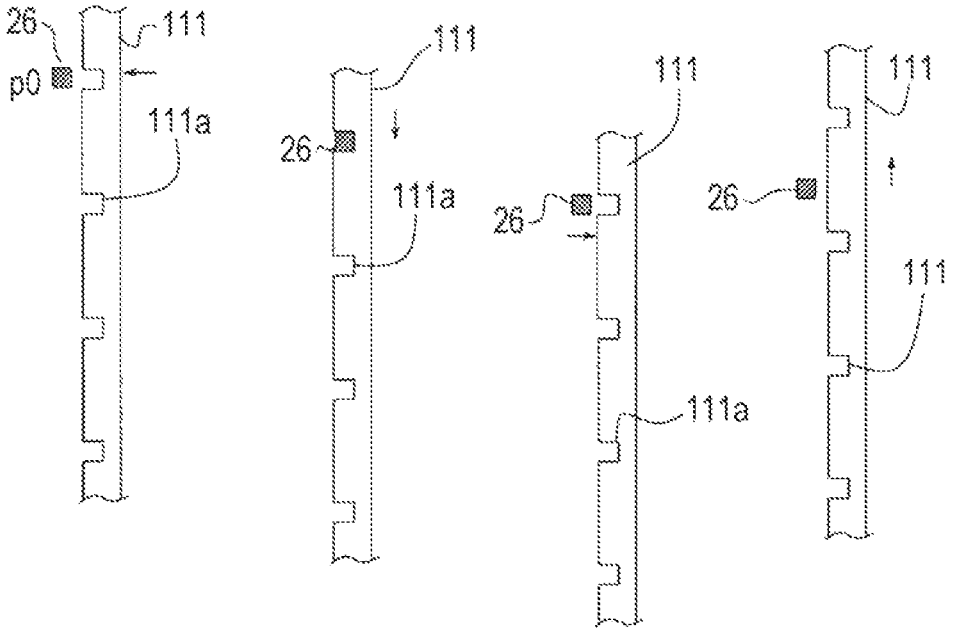
FIGS. 4B to 4E show a movement of the multi-hook.
Figures 4F, 4G, 4H:
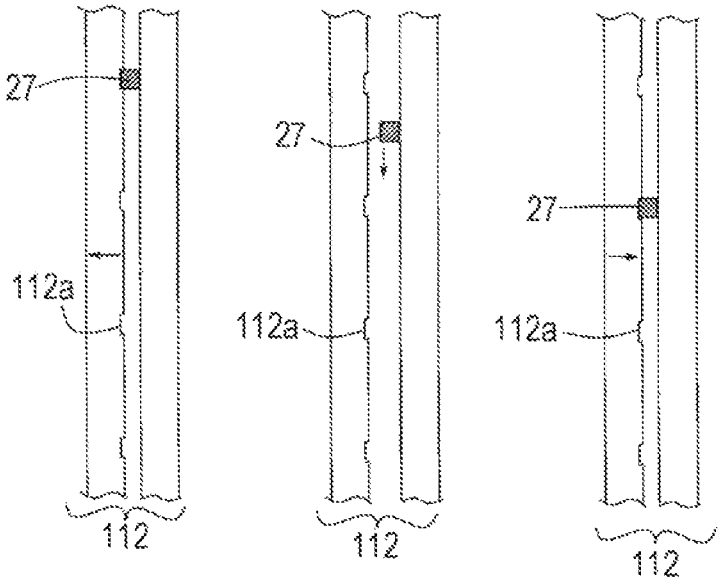
FIGS. 4F to 4H show a movement of the hold bars.
Figure 4I:
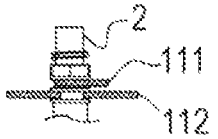
Figure 4J:
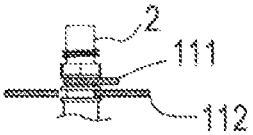
Figure 4K:
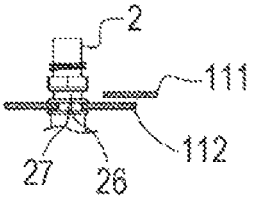
Figure 4L:
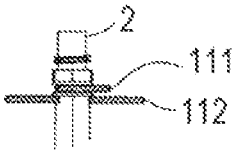
Figure 4M:
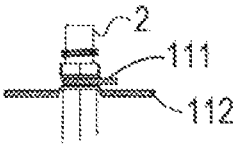
Figure 4N:
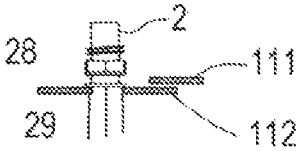

FIGS. 4A to 4N show details of the conveyor line 110. The conveyor line 110 has a multi-hook 111 and hold bars 112. FIG. 4A is a cross-sectional view showing overlap of the multi-hook 111 and the hold bars 112. The hold bars 112 fit onto the lower neck 27 from both the front and back sides of the spout-equipped bag 1. FIGS. 4B to 4E show a movement of the multi-hook 111. FIGS. 4F to 4H show a movement of the hold bars 112. In these figures, a hatched rectangle indicates the rectangle in which the cross-section of the neck 26 or 27 of the spout-equipped bag 1 is inscribed.

The multi-hook 111 fits onto only one of the front and back of the spout-equipped bag 1. A plurality of hooks 111*a* are provided at equal intervals along a long side on one side of a straight main body of the multi-hook 111. Each of the hooks 111*a* has a cutout shape fitting onto the upper neck 26 and suspends the spout-equipped bag 1. The multi-hook 111 moves by a distance by which the spout-equipped bag 1 is intermittently conveyed such that the plurality of hooks 111*a* move along the movement straight line TL in which the spout-equipped bag 1 is conveyed. Thereafter, the multi-hook 111 departs from the movement straight line, bypasses the movement straight line TL, and returns to an original position along the movement straight line TL. When the multi-hook 111 departs from the movement straight line TL, it cooperates with the hold bars 112 to release the spout-equipped bag 1. When the multi-hook 111 returns, it cooperates with the hold bars 112 to suspend the spout-equipped bag 1 by the hooks 111*a*. n times the distance between adjacent hooks 11*a* corresponds to an intermittent moving distance of the multi-hook 111, that is, an intermittent conveying distance of the spout-equipped bag 1. The n is the number of plural juxtaposed spout-equipped bags 1 to be processed. In the case of conveying two juxtaposed spout-equipped bags 1, the multi-hook 111 moves by twice the distance between the hooks 111*a*. The n is a positive integer.

The hold bars 112 are provided along the main body of the multi-hook 111. The hold bars 112 sandwich the lower neck 27 of the stopping spout 2 from both sides thereof. Further, the hold bars 112 have a function of holding the spout-equipped bag 1 in order to suppress a change in behavior of the spout-equipped bag 1 during the operation while the intermittent movement is stopped. Due to this holding function, when the spout-equipped bag 1 stops in the intermittent movement, the hold bars narrow their interval and sandwich the spout. Places for holding the spout, which are referred to as "holds", are provided at equal intervals respectively corresponding to places of stopping of the intermittent movement. In the present Example, a cutout-shaped hold 112*a* is provided on one side (or on both sides) of the hold bars 112. The neck 27 of the spout-equipped bag 1 is enclosed and sandwiched in the hold 112*a*. The hold 112*a* is provided corresponding to the stop position of the intermittent movement.

FIGS. 4I to 4K show a relationship of the necks 26 and 27 to the multi-hook 111 and the hold bars 112. In FIG. 4F, it is assumed that there is the spout-equipped bag at a position p0. In FIG. 4B, the multi-hook 111 has returned to the original position along the movement straight line TL. Thus, the spout-equipped bag 1 is suspended by the multi-hook 111. The neck 26 at this time is in a state shown in FIG. 4I. Thereafter, the hold bars 112 extend the interval. In FIG. 4C, the multi-hook 111 move along the movement straight line TL. In FIG. 4G, the spout-equipped bag 1 moves between the hold bars 112. The necks 26, 27 at this time are in a state shown in FIG. 4J. When the movement of the multi-hook 111 on the movement straight line TL is stopped, the hold bars 112 narrow the interval and hold the spout-equipped bag 1. The necks 26 and 27 at this time are in a state shown in FIG. 4K. In FIG. 4D, the multi-hook 111 departs from the movement straight line TL. At this time, the spout-equipped bag 1 is obtained by the hold 112*a*. In FIG. 4E, the multi-hook 111 return to the original position as shown in FIG. 4B via a bypass path.

FIGS. 4L and 4M show a relationship between the multi-hook 111, the hold bars 112, and necks 28, 29 of the spout-equipped bag 1 having two flanges. FIG. 4I corresponds to FIG. 4L. Thereafter, the hold bars 112 extend the interval. In FIG. 4M, the spout-equipped bag 1 moves between the hold bars 112. When the movement of the multi-hook 111 on the movement straight line TL is stopped, the hold bars 112 narrow the interval and hold the spout-equipped bag 1. The necks 28 and 29 at this time are in the state shown in FIG. 4N. Note that the hold 112*a* is preferably a cutout corresponding to the neck 29. It is preferable that the multi-hook 111 be disposed just below the flange of spout-equipped bag 1 having one flange, and further, the hold bars 112 are arranged below the multi-hook 111.

The multi-hook 111 sequentially conveys the spout-equipped bag 1 downstream of the conveyor line 110 by reciprocating motion. Therefore, a range in which the hooks 111*a* of the multi-hook 111 located in the cleaning step 150 move is fixed. Therefore, the dirt scattered in the cleaning step 150 is restrained from moving upstream of the conveyor line 110 and accumulating. As a result, the contamination of the empty spout-equipped bag 1 received from the bag supply apparatus 120 is avoided. In this way, as an effect generated by conveying the spout-equipped bag 1 on the movement straight line TL, first, a printing defect caused by the dirt adhering to the spout-equipped bag 1 is avoided. When the dirt adheres to a predetermined printing portion and the printing is performed there, falling out of print tends to occur. However, the filling apparatus of the present Example can suppress the falling out of print. Further, for example, time for cleaning is less than that of a general turntable filling machine. Furthermore, it is also avoided to take measures to restrain contamination range from extending.

FIGS. 5A to 5J show movement of loading the spout-equipped bag 1 onto the conveyor line 110 (FIGS. 5A to 5E) or movement of unloading the spout-equipped bag 1 from the conveyor line 110 (FIGS. 5F to 5J), in a direction intersecting the movement straight line TL. In the figures, the hold bars 112 are indicated by broken lines.

Figure 5A:
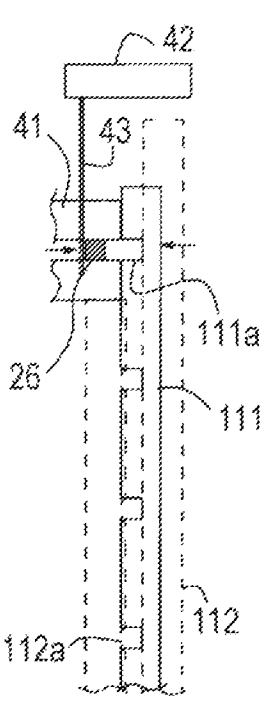
FIGS. 5A to 5J show a movement in which the spout-equipped bag is loaded onto or unloaded from the conveyor line in a direction intersecting a movement straight line.
Figure 5B:
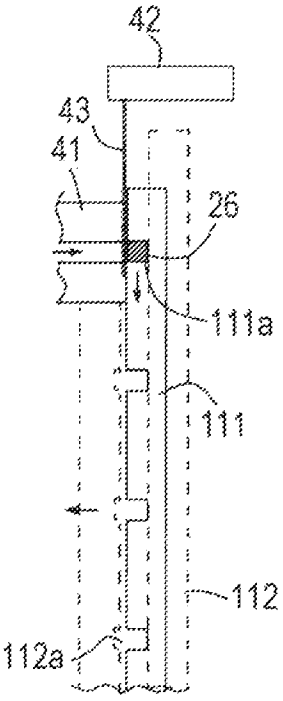
Figure 5C:
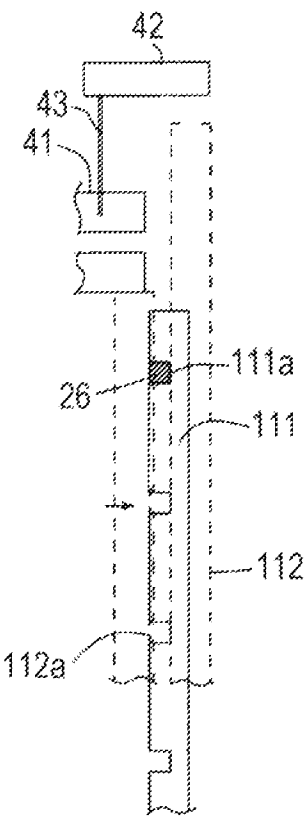
Figure 5D:
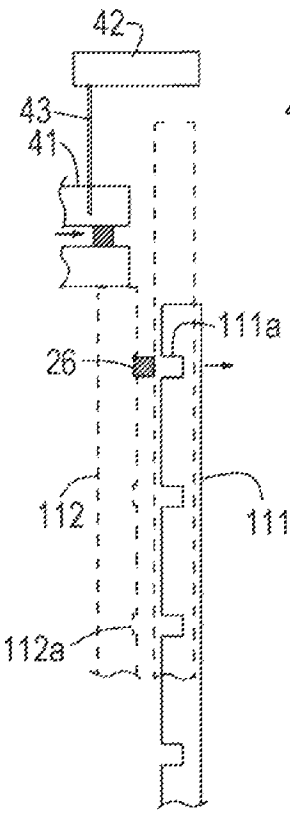
Figure 5E:
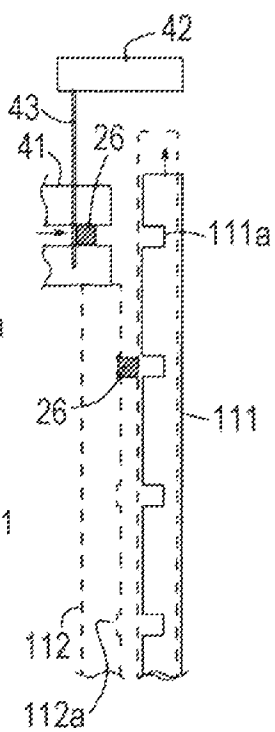
Figure 5J:
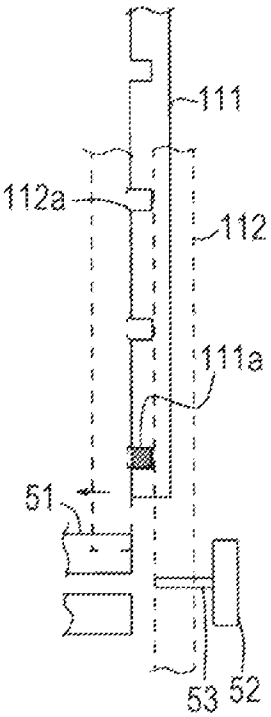

In FIG. 5A, the spout-equipped bag 1 is conveyed on a transfer rail 41 to a vicinity of the conveyor line 110. A delivery device 42 delivers the spout-equipped bag 1 on the transfer rail 41 to the conveyor line 110. The delivery device 42 uses an arm 43 to push out the spout-equipped bag 1 from behind to mount the bag on the multi-hook 111 of the conveyor line 110. Thereafter, the delivery device 42 releases the arm 43 (FIG. 5B). The multi-hook 111 moves along the movement straight line TL to mount the neck 27 of the spout-equipped bag 1 on the hold bars 112 (FIG. 5C). Then, as shown in FIGS. 5D and 5E, the multi-hook 111 departs from the movement straight line TL. Thereafter, the multi-hook 111 return to the position shown in FIG. 5A via the bypass path.

Figure 5I:
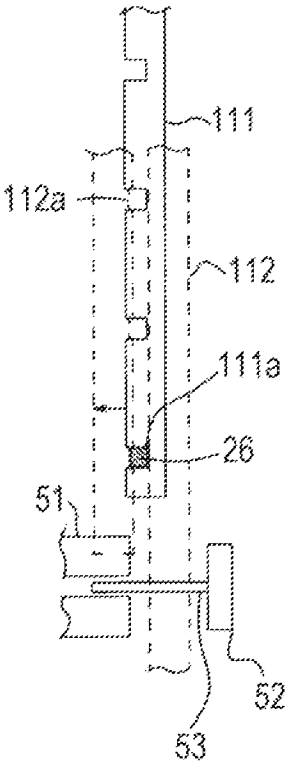
Figure 5H:
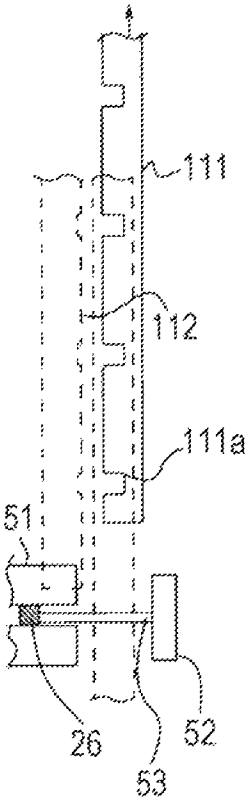
Figure 5G:
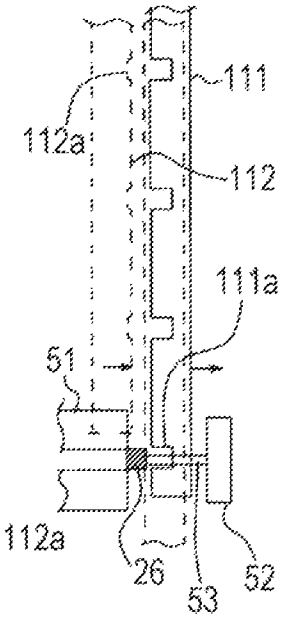
Figure 5F:
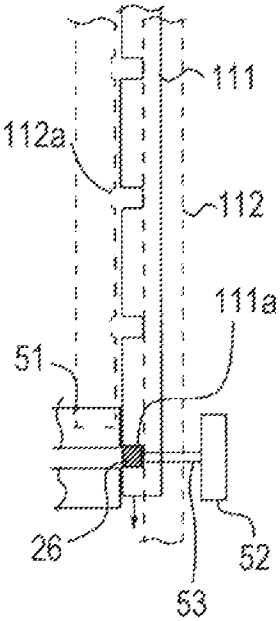

In FIG. 5F, the delivery device 52 delivers the spout-equipped bag 1 located on the most downstream of the conveyor line 110 to a transfer rail 51. The delivery device 52 uses an arm 53 to push out the spout-equipped bag 1 stopped in front of the transfer rail 51 from behind (FIG. 5F), and mounts the bag on the transfer rail 51 (FIG. 5H). Thereafter, the delivery device 52 operates to release the arm 53 (FIG. 5I). On the other hand, as shown in FIGS. 5G and 5H, the multi-hook 111 departs from the movement straight line TL. Thereafter, the multi-hook 111 return to the position shown in FIG. 5I via the bypass path. Then, the multi-hook 111 suspends the next spout-equipped bag 1. The multi-hook 111 moves the next spout-equipped bag 1 on the movement straight line TL (FIG. 5J), and stops in front of the transfer rail 51.

(Bag Supply Apparatus)

Figure 3:
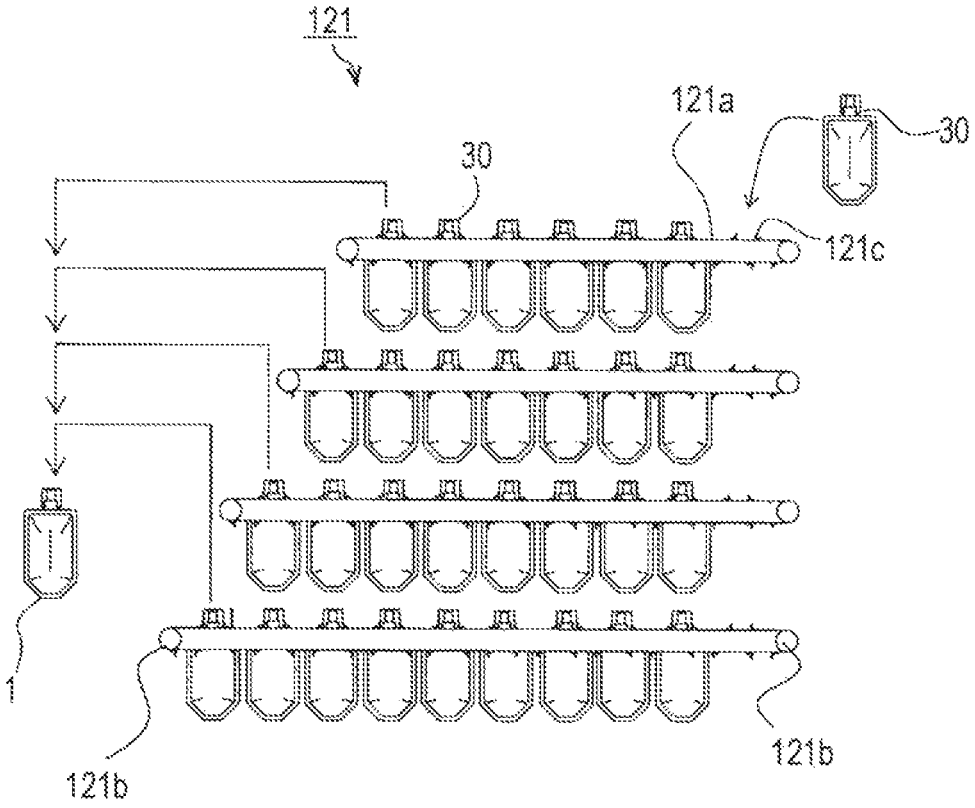
FIG. 3 schematically shows a side of a conveying device.

Returning to FIG. 2, the bag supply apparatus 120 has a conveying device 121, a robot 122, a transfer rail 123, a sending-out device 124, and a delivery device 125. Note that only the transfer rail 123 and the delivery device 125 corresponding to the spout-equipped bag 1 taken out on the back side of the drawing are shown. The transfer rail and the delivery device arranged on the front side of the drawing are omitted. The conveying device 121 has a structure including a pair of endless chains 121*a* stacked hierarchically. Each pair of endless chains 121*a* carries a plurality of magazines 30 shown in FIG. 1F in a bridging manner. The pair of endless chains 121*a* is intermittently cyclically driven by a sprocket 121*b*. FIG. 3 schematically shows a side of the conveying device 121. Each pair of endless chains 121*a* is provided with a frame 121*c* for positioning the magazines 30. An operator can set the plurality of magazines 30 in the conveying device from the right side of the drawing. The pair of endless chains 121*a* rotates counterclockwise in the drawing.

Returning to FIG. 2, the robot 122 picks up the magazines 30 on the endless chains 121*a* and sets them in the sending-out device 124. When the magazines 30 are picked up, the pair of endless chains 121*a* moves the new magazines 30 to the final end and stops them. The robot 122 can obtain the magazines 30 from the endless chains 121*a* on any stage.

The sending-out device 124 transfers the spout-equipped bag 1 to the transfer rail 123 from the magazine 30 set by the robot 122. The sending-out device 124 can move a pushing member 124*a* in a direction of the conveyor line 110 by a linear sliding air cylinder (not shown). The pushing member 124*a* transfers the spout-equipped bag 1 to the transfer rail 123 existing on an extension of the magazine 30 by pushing the back of the spout-equipped bag 1 held in the magazine 30. In the present Example, two magazines 30 are set in the sending-out device 124 by the robot 122. The spout-equipped bags 1 are taken out in parallel from the magazines. Thus, the pushing member 124*a* simultaneously pushes the back of two rows of spout-equipped bags 1 held in the two magazines 30. Correspondingly, two transfer rails 123 parallel to each other are arranged.

The transfer rail 123 is vibrated by a vibration device (not shown) to convey the spout-equipped bag 1 to the uppermost stream of the conveyor line 110. The transfer rail 123 is inclined slightly downward toward the conveyor line 110 side. First and second stoppers (not shown) which can be advanced and retracted are provided near an end of the conveyor line 123 on the conveyor line 110 side. These stoppers contact a leading bag and a second bag to temporarily stop their advance. The delivery device 125 delivers the leading spout-equipped bag 1 on the transfer rail 123 to the conveyor line 110. The conveyor line 110 is perpendicular to the transfer rail 123. Therefore, a conveyance direction of the spout-equipped bag 1, which has been conveyed on the transfer rail 123 in the thickness direction a1 of the bag 3, is converted to the width direction a2 of the bag 3, after the spout-equipped bag 1 is transferred to the conveyor line 110 by the delivery device 125.

(Spout Wash)

Figure 10A:
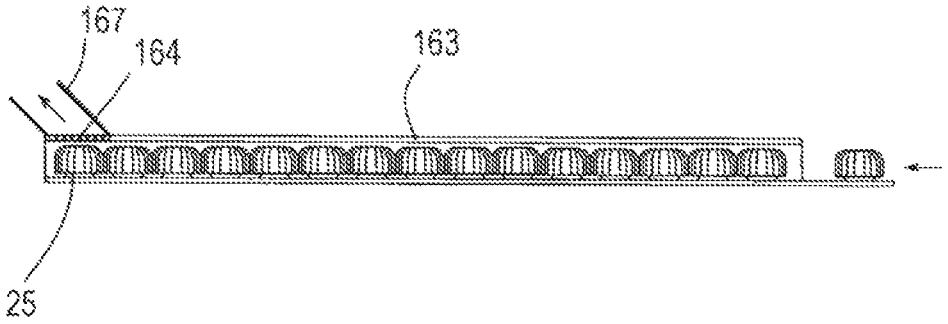
Figure 10B:
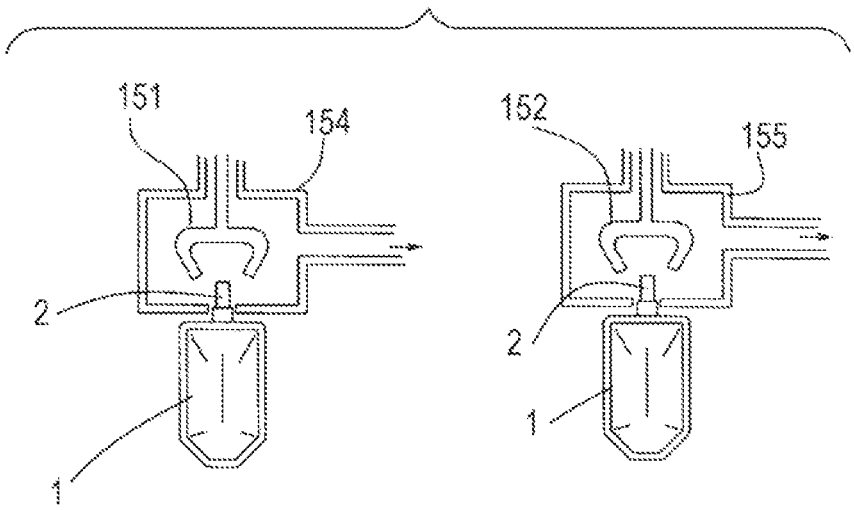

In the cleaning step 150, spraying of the cleaning solution and the air is performed. Thus, the outer surface of the spout 2 is cleaned. FIG. 10B shows the spraying of the cleaning solution by the nozzle 151 and the air by the nozzle 152. The spout 2 protruding above the conveyor line is surrounded by shells 154 and 155. Then, inside of the shells 154 and 155 is sucked. Thus, the cleaning solution and the blown air are recovered. When the cleaning solution is scattered, a spot where the scattered cleaning solution adheres becomes a growth source of bacteria. In addition, if the scattered cleaning solution adheres to the printing apparatus, a failure occurs in the printing apparatus.

(Screw Cap Supply Apparatus)

The screw cap 25 is conveyed from the screw cap supply apparatus 161 toward the spout-equipped bag. A part of a conveyor path is a pipe conduit 162. The screw cap 25 is blown into the pipe conduit 162 by the air from an inlet side of the pipe conduit 162. Further, the pipe conduit 162 is vibrated by a vibrator (not shown). The screw cap 25 advances due to the vibration. In this way, the screw cap 25 is supplied to the spout 2 while the intermittent movement is stopped. Instead of advancing the screw cap 25 by the vibration, a negative pressure source 167 may be provided on an outlet side of the pipe conduit 162 as a pipe conduit 163 covering the whole way to the spout as shown in FIG. 10A. A mesh 164 is a mesh-like member which allows the sucked air to pass therethrough. When the screw cap 25 is conveyed by the air, even if the dust is sent out from inside the screw cap supply apparatus 161, the dust passes through the mesh 164 and is discharged from the negative pressure source 167. The negative pressure source 167 has a function of assisting the movement of the screw cap 25 in the pipe conduit 162.

(Screw Cap Tightening Inspection)

In the final tightening, the driver 166 detects a final torque value when the screw cap 25 is tightened on the spout 2 and a tightening position of the screw cap 25 on the spout 2. The driver 166 is rotationally driven by a servomotor. A current value can be obtained as information indicating the torque value. Further, the number of drive pulses can be obtained as information indicating a rotation angle. The spout 2 and the screw cap 25 are members made of synthetic resin. A mold used to mold the members wear after prolonged use. Therefore, a slight change occurs in a shape of the molded spout 2 or screw cap 25. The spout-equipped bag 1 is filled with the liquid material and then stored for a relatively long time. Therefore, if there is a slight gap in screwing between the spout 2 and the screw cap 25, the contents may be rotted by entry of outside air during a storage period. When the spout 2 or screw cap 25 having a changed shape is screwed, the tightening torque value or the stop position of the screw cap 25 changes. Therefore, storing the torque values and stop positions as log data in a controller (not shown) is effective in investigating a cause of failure when a defect is found.

Figure 10C:
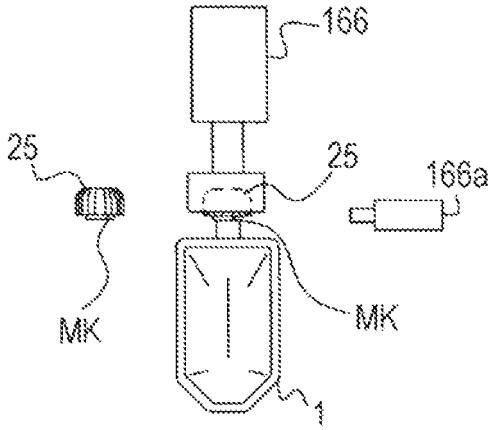
Figure 10D:
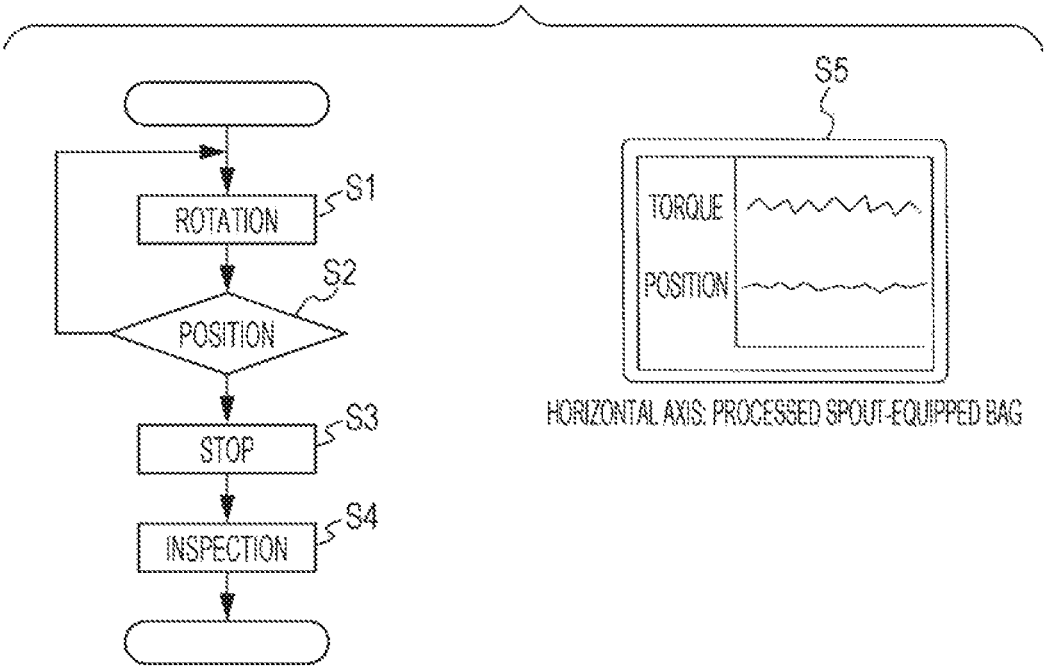

FIG. 10C and FIG. 10D show an example of a step of performing the final tightening. The final tightening is controlled by the controller (not shown). A flow of FIG. 10D is a process flow including the steps by the controller. The controller obtains drive current of the driver 166 from a current measuring device (not shown). Further, the controller sends the drive pulse to the servomotor of the driver 166. In a process flow S1, the controller obtains a drive current value of the driver 166 during rotation. Then, the controller detects the obtained drive current value as a current torque value (current value of the driver 166). In the process flow S1, it is detected whether the current torque value has reached a predetermined torque value by comparing the current torque value with the predetermined torque value. In a process flow S2, a known pattern matching process is performed on the image of the camera 166*a*. Specifically, it is detected whether a mark MK provided on the screw cap 25 has reached a predetermined rotational position. In a process flow S3, as a result of the pattern matching process, when the mark MK reaches the predetermined position, rotation of the driver 166 is stopped. The torque value is also detected from the drive current value at that time. In a process flow S4, counting of a counter in the controller is started after reaching the predetermined torque value. Thereafter, the controller counts up the counter each time the drive pulse is generated. When the predetermined rotational position is reached, the count value up to that point is detected as the rotation angle (the number of drive pulses of the driver 166). As the mark MK, for example, a cut of a proof band provided on the screw cap 25 in order to provide a tamper evidence (tamper proof) function can be used. It is determined whether a sealed state between the screw cap 25 and the spout 2 is acceptable based on the predetermined position at which the mark MK should originally stop. However, the rotation angle detected in S4 may change due to influence of moisture adhering to the spout 2. In preparation for such a case, both the torque value by the driver 166 and the stop position of the mark MK by the camera 166*a* are preferably detected and managed. Thus, the sealed state between the screw cap 25 and the spout 2 can be managed. Further, the detected torque value and rotation angle may be associated and stored in the controller or graphed. Thus, a central position of acceptance determination of the sealed state between the screw cap 25 and the spout 2 can be set or changed automatically or manually. In FIG. 10D, the torque value when the rotation of the driver 166 is stopped and the stop position of the mark MK are displayed. However, the torque value when the rotation of the driver 166 is stopped and the rotation angle from the stop position of the mark MK to the predetermined rotational position may be displayed.

(Weight Measurement Process)

Figure 7A:
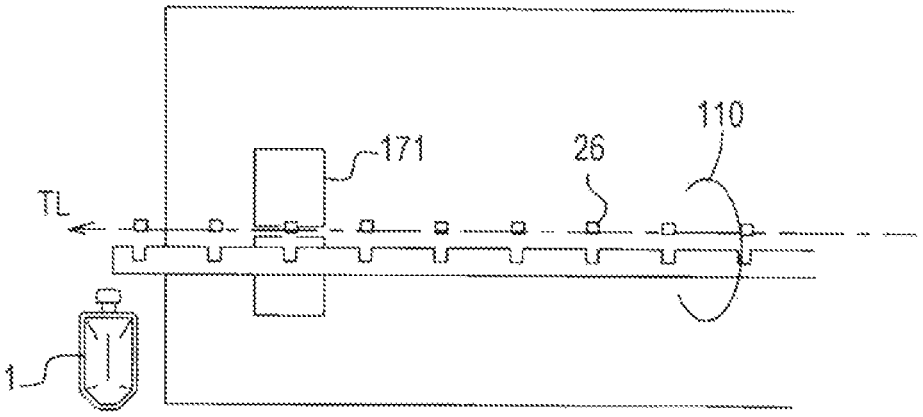
FIGS. 7A to 7D are diagrams for explaining filling weight measurement.
Figure 7B:
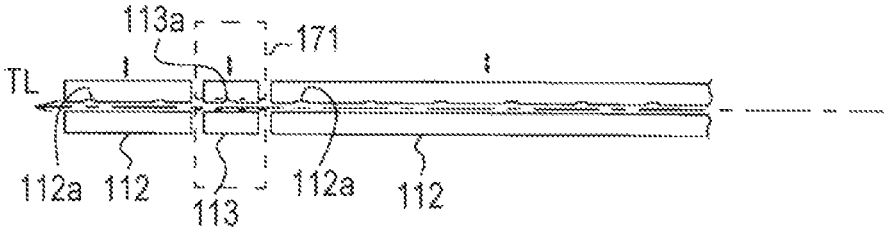

The weight of the filled spout-equipped bag 1 is measured by the weighing scale 171 as shown in FIG. 7A. The hold bar 112 is divided at a position of the weighing scale 171. A hold bar 113 connected to a balance of the weighing scale 171 is provided. As shown in FIG. 7B, the weight of only the spout-equipped bag 1 held by the hold bar 113 is measured by the weighing scale 171. A measuring hold 113*a* of the hold bar 113 is disposed in place of a part of the hold 112*a* disposed at equal intervals along the movement straight line TL. In the conveyor line 110, a position of a center of gravity of the spout-equipped bag 1 filled with the liquid material is moved to below the spout. When the spout-equipped bag 1 stops at the position of the weighing scale 171, the spout-equipped bag 1 is flexible in the thickness a1 direction of the bag 3 and is hard in the width a2 direction of the bag 3. Further, the upper edge seal portion 33 also has high rigidity in the width a2 direction of the bag 3. Even if the position of the center of gravity is lowered, the swinging of the spout-equipped bag 1 is small when the spout-equipped bag 1 is stopped after intermittent conveyance on the movement straight line TL in the conveyor line 110. Therefore, even when the weight is measured by the weighing scale 171 provided at a temporary stop position of the conveyor line 110, a time until the swinging is stopped is extremely short. On the other hand, in the case of intermittent conveyance using a general turntable, the spout-equipped bag 1 is rotated in the width direction. Therefore, the spout-equipped bag 1 swings greatly due to the centrifugal force acting in the thickness direction of the bag 3. Therefore, it takes a long time to wait for the swinging to stop. Or, the weight is measured while swinging. This reduces accuracy of weight measurement results.

Figure 7C:
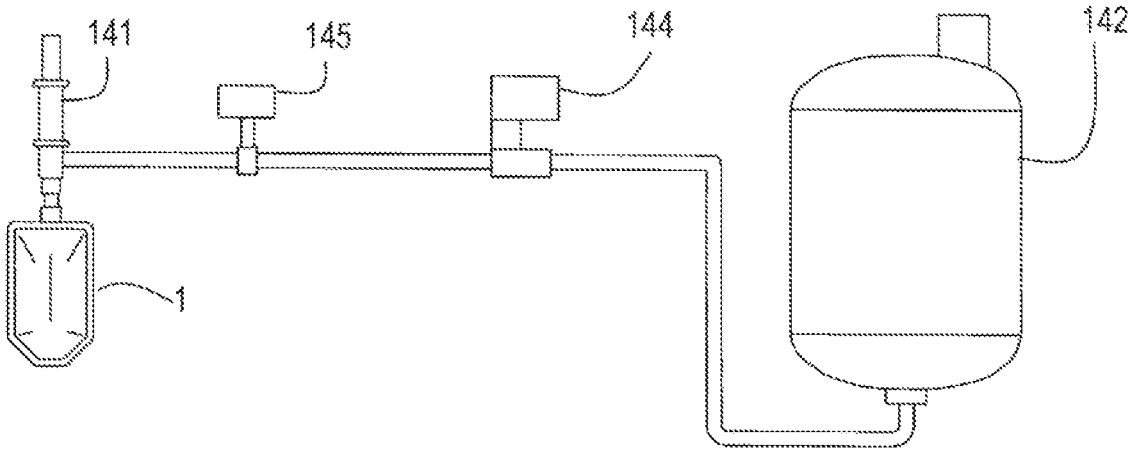
Figure 7D:
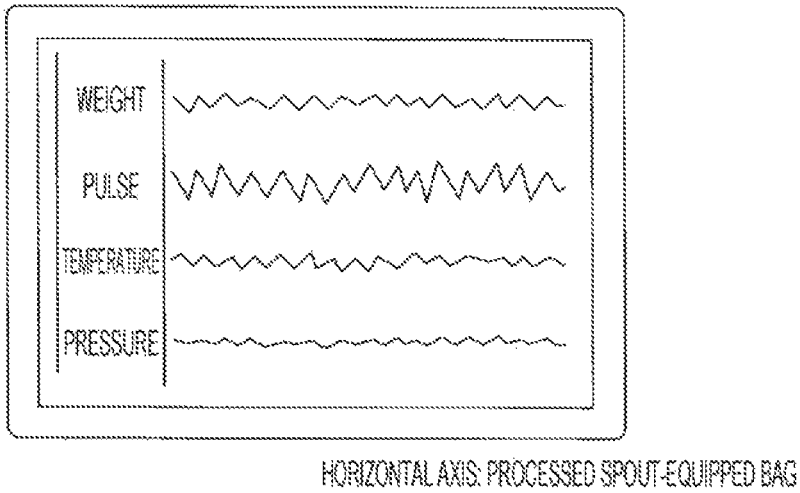

In the present Example, as shown in FIG. 7C, the flow rate (the number of pulses) is measured by the electromagnetic flow meter 144. Further, the sensor 145 measures the temperature of the liquid material and a pressure value in the storage tank at that time. The data of the weight of each spout-equipped bag 1 is stored as log data in the controller (not shown) together with the flow rate (the number of pulses) that is measured by the electromagnetic flow meter 144, or the temperature of the liquid material and the pressure value in the storage tank that time that are measured by the sensor 145, at the time the spout-equipped bag 1 is filled. Since viscosity of the liquid material changes with temperature, the flow rate changes even at the same pressure. Therefore, in order to fill the bag with a predetermined weight, it is effective to save these data as a log. Further, as shown in FIG. 7D, the weight value, the number of pulses, the temperature of the liquid material, and the pressure value in the storage tank of the spout-equipped bag 1 can be preferably displayed in association with each other. Further, the flow rate of the liquid material supplied from the storage tank may be adjusted so that the weight of the predetermined number of spout-equipped bags measured at time intervals matches a target value. Furthermore, the flow rate changes with the temperature of the liquid material. Therefore, the flow rate of the liquid material supplied from the storage tank may be adjusted according to the measured temperature of the liquid material.

Figure 6A:
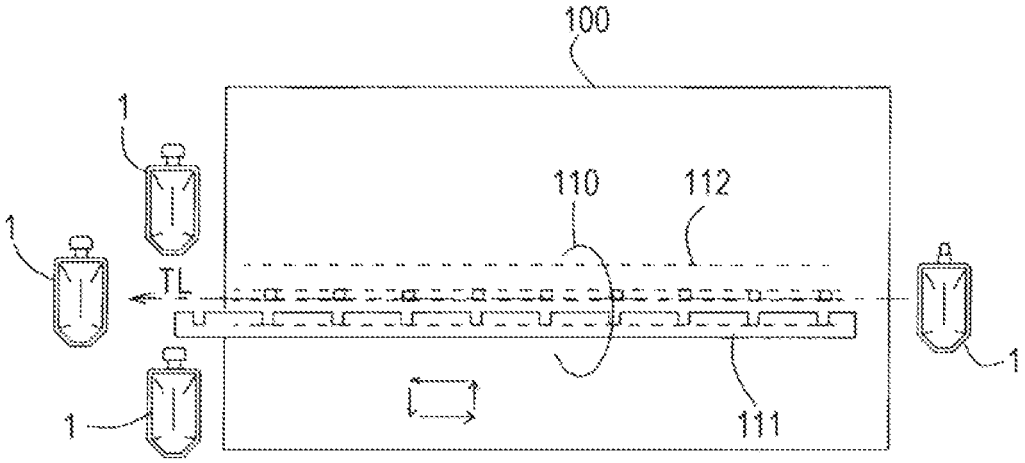
FIGS. 6A to 6C show the conveyor line, a distribution facility, and a stack equipment.
Figure 6B:
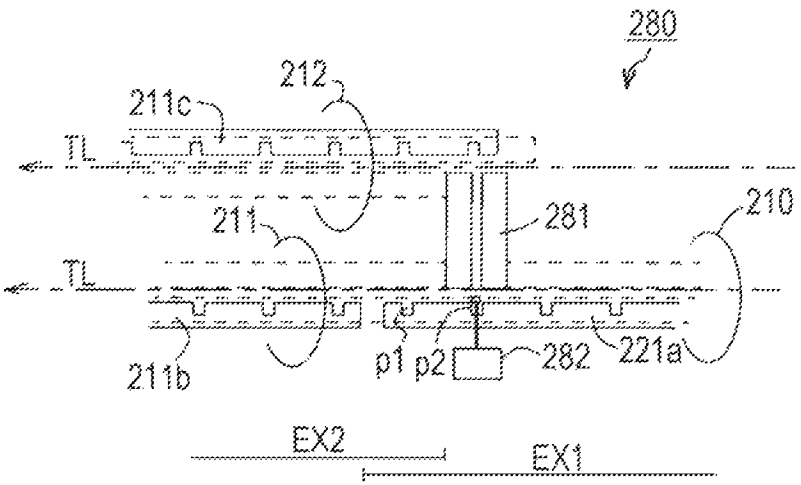
Figure 6C:
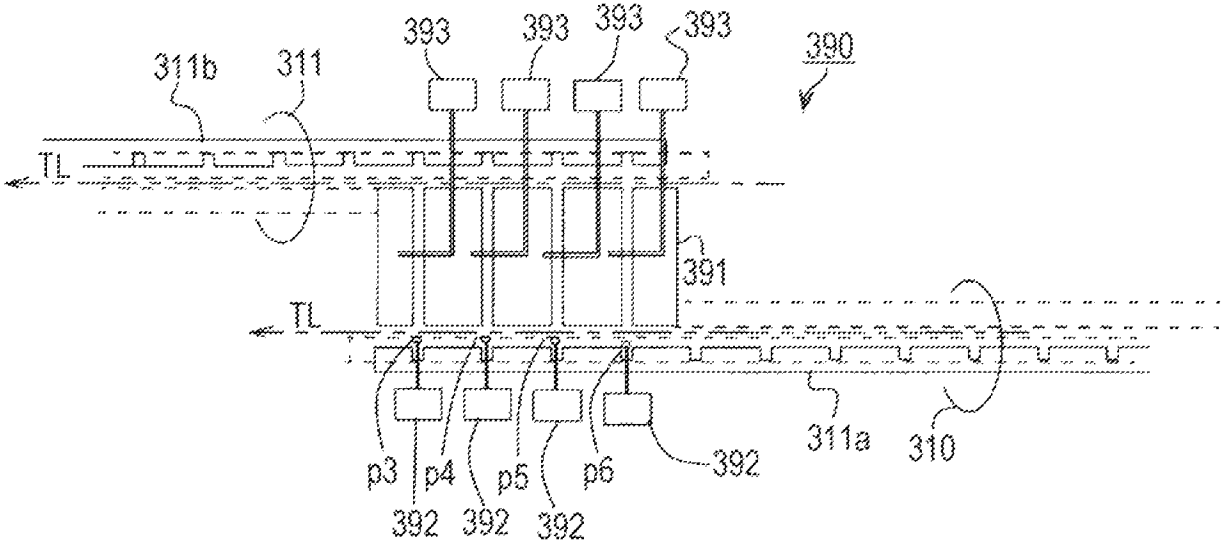

FIGS. 6A to 6C show the conveyor line 110. In FIG. 6A, the multi-hook 111 of Example 1 is continuous from the position in which the empty spout-equipped bag 1 is loaded onto the conveyor line 110 to the position in which it is finally unloaded from the conveyor line 110. The intermittent conveyance distance is twice a spacing between the spout-equipped bags because double parallel transfer is performed (in the case of n-fold parallel transfer, it is n times the spacing between the spout-equipped bags. The n is a positive integer). Three spout-equipped bags 1 on the left side of the drawing indicate directions in which the bags are unloaded from the conveyor line. The spout-equipped bag 1 can be unloaded from the conveyor line 110 in any direction of upper, lower and left directions of the drawing. In this way, a degree of freedom of arrangement of the following sterilization step line can be improved.

Example 2

Figure 8:
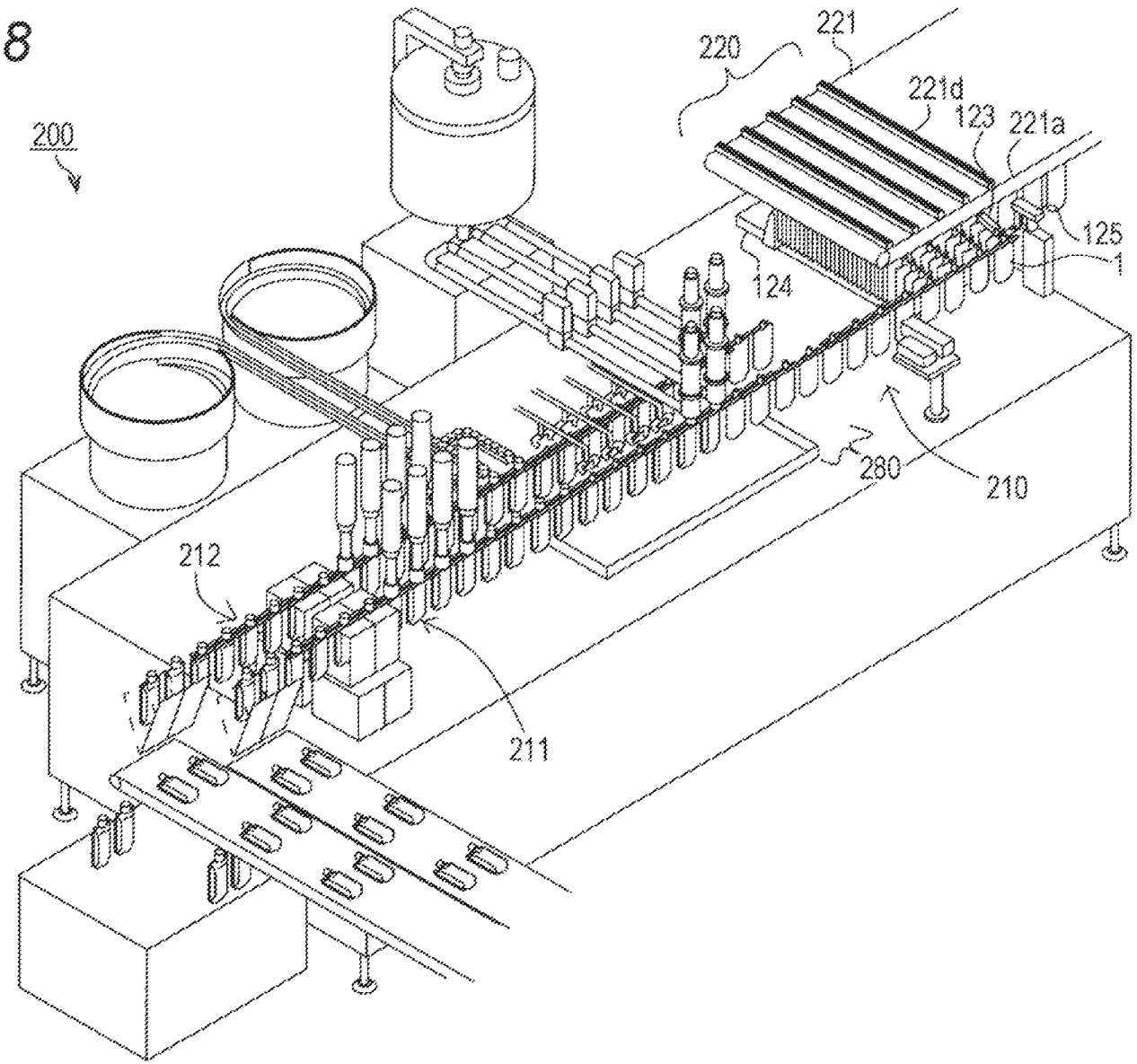
FIG. 8 is a perspective view showing the schematic structure of the filling apparatus according to Example 2.

FIG. 8 shows an entire structure of a filling apparatus 200 of Example 2. In Example 1, the two juxtaposed spout-equipped bags are transferred from the bag supply apparatus 120 to the conveyor line 110. In the conveyor line 110, the two adjacent juxtaposed spout-equipped bags 1 are processed simultaneously. The filling apparatus 200 of the present Example takes out four spout-equipped bags 1 simultaneously from a bag supply apparatus 220. The bags taken out are loaded on a conveyor line 210 and divided two by two by a branch facility 280. Thereafter, the spout-equipped bags 1 are processed by the conveyor lines 211 and 212. In each of the conveyor lines 211 and 212, the two juxtaposed spout-equipped bags 1 are processed simultaneously.

The bag supply apparatus 220 of Example 2 has a plurality of holding rails 221*d* for accommodating a plurality of spout-equipped bags 1. Each holding rail 221*d* has the C-shaped cross-section in the same manner as the magazine 30 shown in FIG. 1F. The plurality of holding rails 221*d* are fixed to a conveyor 221*a* in a bridging manner. The spout-equipped bags 1 are separately transferred from the magazine 30 to the holding rail 221*d*. The sending-out device 124 takes out the spout-equipped bags 1 from the holding rail 221*d* directly to the transfer rail 123. When a structure for taking out the four spout-equipped bags 1 is compared with the bag supply apparatus of Example 1, the difference is only that the multiplicity of the transfer rail 123, the sending-out device 124, and the delivery device 125 that are included in the structure is increased. Therefore, further description of the above-described structure will be omitted.

The conveyor line 210 is provided with the branch facility 280 for distributing the spout-equipped bags 1 to the two conveyor lines 211 and 212. In the conveyor line 210 between the bag supply apparatus 220 and the branch facility 280, an operation of conveying the spout-equipped bags 1 in the width direction a2 by a distance corresponding to the four spout-equipped bags 1 and stop them (quadruple parallel (2×2)) is repeated. Thus, the intermittent conveyance is performed. In each of the conveyor lines 211 and 212 downstream of the branch facility 280, an intermittent conveyance operation of conveying the spout-equipped bags 1 by a distance corresponding to the two spout-equipped bags 1 and stop them (double parallel (2×1)) is repeated. Subsequent steps in each of the conveyor lines 211 and 212 are the same as in Example 1. If the number of parallel transfers on each of the conveyor lines 211 and 212 is n, the number of parallel transfers on the conveyor line 210 is 2×n.

FIG. 6B shows a structure of the branch facility 280 (however, the figure shows a double parallel transfer mode (n=1 mode) instead of a quadruple parallel transfer for simplification). The branch facility 280 has a transfer rail 281 and a delivery device 282. Moreover, the multi-hook is divided into a multi-hook 211*a* for performing the double parallel transfer having a movable range EX1 and multi-hooks 211*b* and 211*c* for performing single parallel transfer having a movable range EX2. The ranges EX1 and EX2 partially overlap each other. The movement straight line of the multi-hook 211*a* overlaps the movement straight line of the multi-hook 211*b* when extended. Among the spout-equipped bags 1 obtained by the hold located at 2×n (here, n=1) at the most downstream of the multi-hook 211*a*, the leading n pieces of bags are suspended by the multi-hook 211*b* performing single parallel transfer. The next n pieces of bags are sent to the conveyor line 212 by the transfer rail 281 and the delivery device 282 and suspended by the multi-hook 211*c*.

Briefly explaining the operation, the intermittently conveyed two spout-equipped bags 1 stop at points p1 and p2 of the multi-hook 211*a*. Next, the multi-hook 211*b* obtains the spout-equipped bag 1 at the point p1 (first of the two). The delivery device 282 delivers the spout-equipped bag 1 at the point p2 (remaining of the two) to the multi-hook 211*c* via the transfer rail 281.

Example 3

Figure 9:
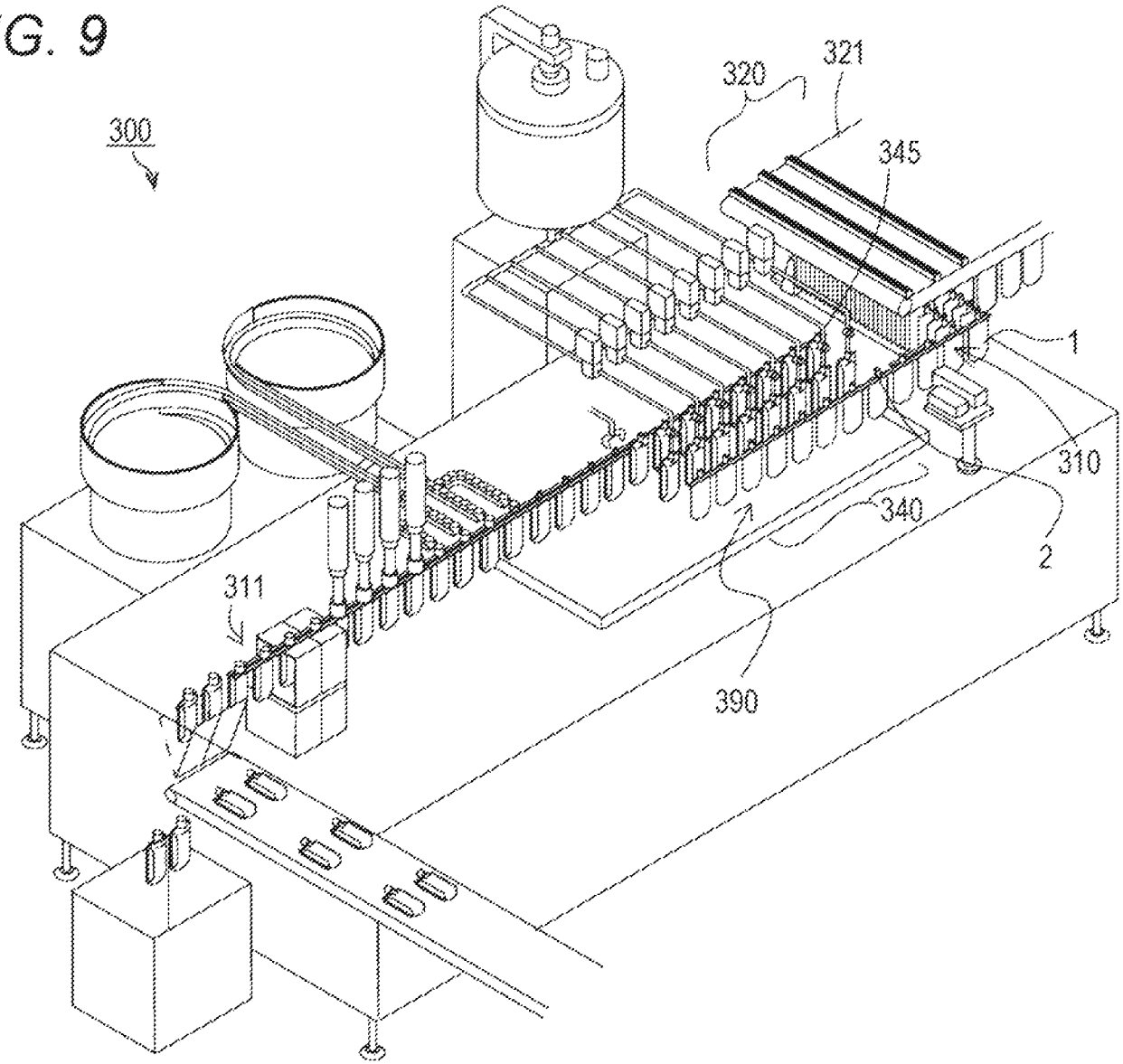
FIG. 9 is a perspective view showing the schematic structure of the filling apparatus according to Example 3.

FIG. 9 shows an entire structure of a filling apparatus 300 of Example 3. In Example 1, when the spout-equipped bag 1 is stopped at a stop point of the conveyor line 110, it is filled with the liquid material. Therefore, it is necessary to complete the filling while the spout-equipped bag 1 is stopped. By pressing the tip of the nozzle 141 against the spout 2 of the spout-equipped bag 1, the nozzle and the bag communicate with each other. In this way, the filling is performed by increasing the flow rate of the liquid material so that the liquid material does not spill out of the spout. In such a filling method, when the nozzle 141 is removed from the spout 2, the liquid material may adhere to the outside of the spout 2. Therefore, cleaning of the next step is necessary.

On the other hand, in the filling apparatus 300 of Example 3, a nozzle 345 is inserted into an inside of a mouth of the spout 2 of the spout-equipped bag 1 in a noncontact manner. Therefore, the bag can be filled with the liquid material slowly over time as compared with the former Example 1. Therefore, in the present Example, a filling step 340 includes a stack equipment 390 of the spout-equipped bags 1. The spout-equipped bags 1 intermittently conveyed by a conveyor line 310 are temporarily stacked (accumulated) four times (for example, 2×4=8). Then, the filling is simultaneously started by nozzles 345 provided in plurality. When the filling is completed, the spout-equipped bags 1 are delivered to a downstream conveyor line 311. For example, in the case of n-fold parallel transfer, m times n (m is a positive integer), that is, n×m spout-equipped bags 1 are stacked. The conveyor lines 310 and 311 upstream and downstream of the stack equipment 390 are the same as in Example 1. Therefore, a description thereof will be omitted.

FIG. 6C is a diagram showing a structure of the stack equipment 390. However, the figure shows an example in which four (m=2 double parallel transfer) spout-equipped bags are stacked instead of eight spout-equipped bags for simplification. The stack equipment 390 has a transfer rail 391 and delivery devices 392 and 393. Hereinafter, an operation of the stack equipment 390 will be described. The four spout-equipped bags 1 stop at points p3, p4, p5 and p6 of the multi-hook 311*a* of the conveyor line 310 after the intermittent conveyance. The four spout-equipped bags 1 are respectively arranged at positions directly facing the four transfer rails 391. Then, the spout-equipped bag 1 at each position is sent to a filling position by the delivery device 392. By the time the filling is completed, the four spout-equipped bags 1 are again arranged at the points p3, p4, p5 and p6. Therefore, the spout-equipped bags 1 after the filling is completed are moved to the multi-hook 311*b* of the conveyor line 311 by the delivery device 393. On the other hand, the delivery device 392 moves the new spout-equipped bags 1 to positions waiting for filling. In the present Example, the number of transfer rails 391 is four. However, the number is generally n×m.

According to Examples 1 to 3 described above, the multi-hook only reciprocates the predetermined distance. Therefore, an effect is obtained that the contamination does not easily move upstream of the conveyor line. Further, the conveying direction of the spout-equipped bag 1 is linear in the width direction of the spout-equipped bag. Therefore, the operation management in inspection of the print results on the spout is improved. That is, when inspecting the printing by the camera, the camera images the spout-equipped bags 1 conveyed in parallel. Therefore, there is less false detection. In the case of the general turntable filling machine, it is difficult to image the spout-equipped bags 1 that is being conveyed in an unstable state being inclined by the centrifugal force. Therefore, it is necessary to capture the image after inclination of the spout-equipped bag 1 is eliminated after conveyance. However, in the present Example, the swinging due to the centrifugal force does not occur. That is, when the spout-equipped bag 1 is conveyed in the width direction a2 of the bag 3, the spout-equipped bag 1 that is being conveyed is less likely to swing because the upper edge seal portion 33 bonding the spout 2 and the bag 3 has a high rigidity. On the contrary, when the spout-equipped bag 1 is conveyed in the thickness direction a1 of the bag 3, the spout-equipped bag 1 easily swing around the upper edge seal portion. As described above, in the present Example, since the spout-equipped bag 1 is not inclined, it is possible to capture the image from the front even at the moment when the spout-equipped bag 1 is conveyed.

According to Examples 1 to 3 described above, the conveyor line is a straight line. Further, the steps are arranged on the straight line. Therefore, the number of spout-equipped bags that can be multiply arranged in parallel can be increased. Further, the spout-equipped bag 1 can be unloaded in a desired direction after the steps are completed. Furthermore, the spout-equipped bag can be conveyed according to an equal interval between the hooks. Therefore, by setting a position of each step according to this interval, an effect of ensuring accurate conveyance can be obtained. In Examples 1 to 3 described above, the hook 111*a* fitted onto the neck 26 on the upper side of the spout-equipped bag 1 is the cutout. However, the hook 111*a* may have a mechanism for picking the neck 26.

Example 4

Figure 11A:
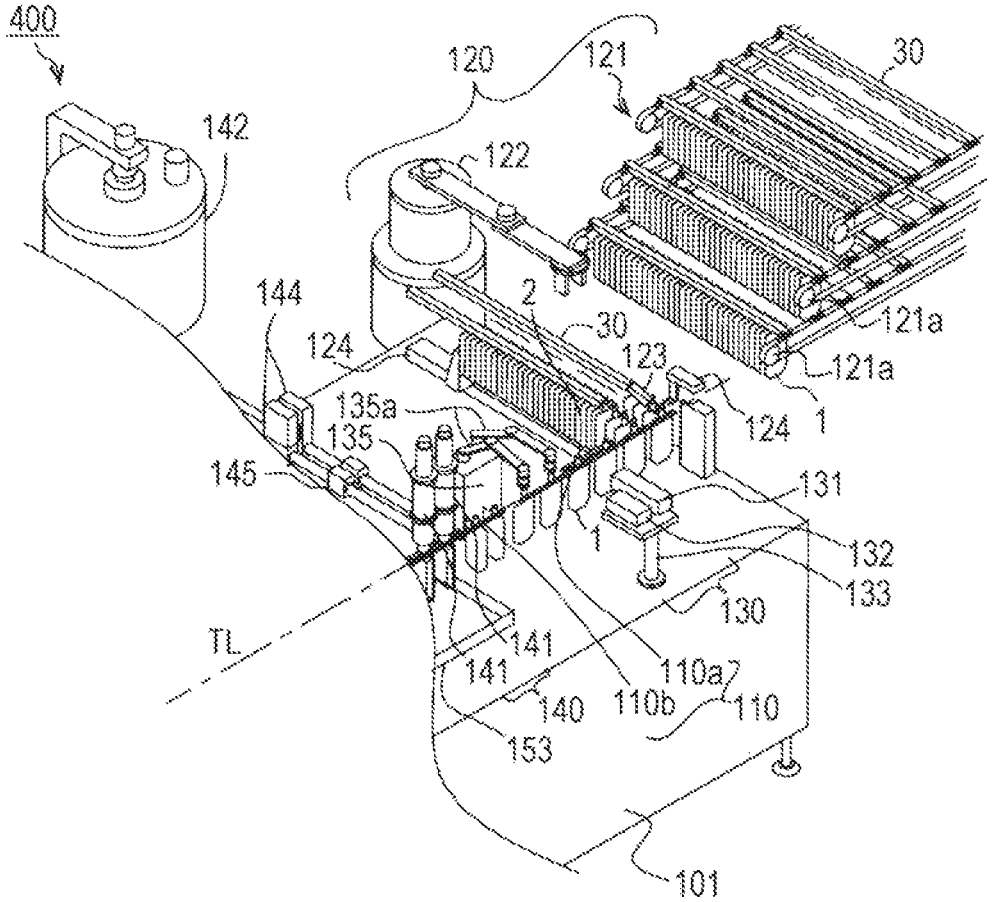
FIGS. 11A and 11B are diagrams showing the schematic structure of the filling apparatus according to Example 4.
Figure 11B:
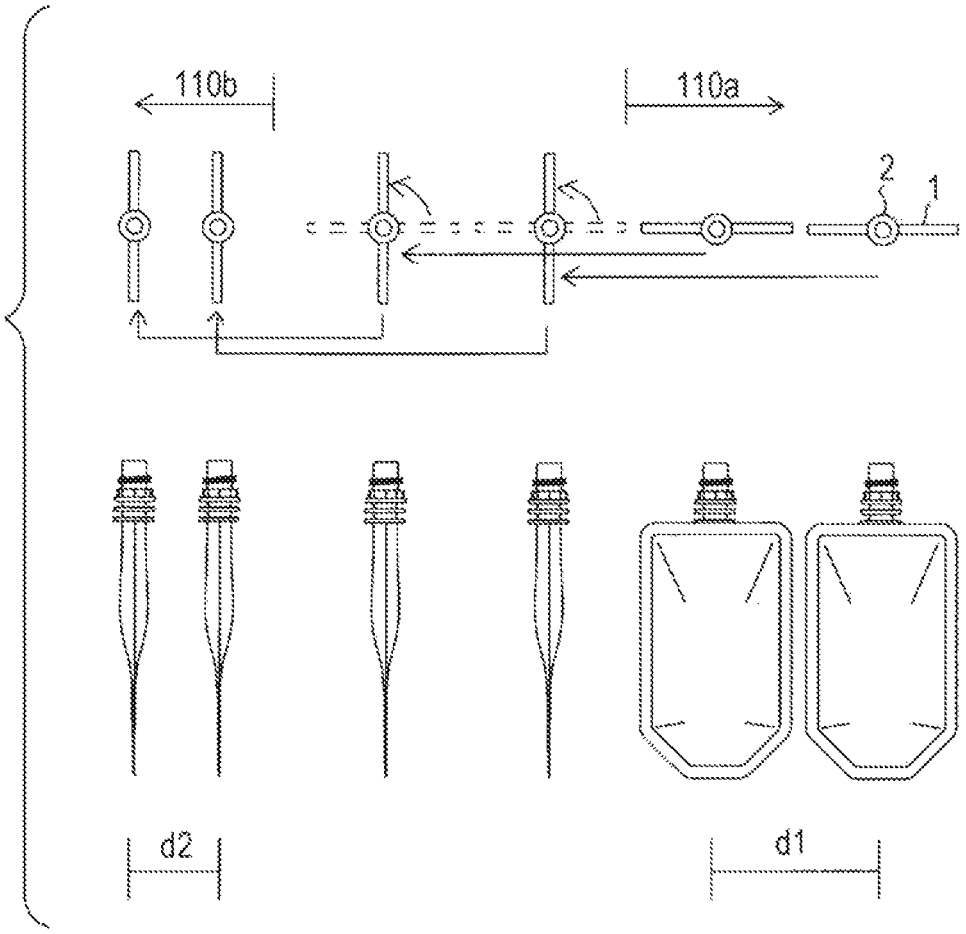

FIGS. 11A and 11B show a structure of a filling apparatus 400 of Example 4. In Example 1, the conveyor line 110 conveys the spout-equipped bag 1 in the width direction of the spout-equipped bag 1 on the whole way from the bag supply apparatus 120 to the sorting machine 181 for unloading the spout-equipped bag 1. On the other hand, in the filling apparatus 400 of Example 4, a direction conversion portion 135 is provided between the printing apparatus 131 and the nozzle 141 along the movement straight line TL of the conveyor line 110. The direction conversion portion 135 converts the conveying direction of the spout-equipped bag 1 from the width direction a2 of the spout-equipped bag 1 to the thickness direction a1 of the spout-equipped bag 1. Hereinafter, the conveyor line 110 on the printing apparatus 131 side is referred to as a conveyor line 110*a*, and the conveyor line 110 on the nozzle 141 side is referred to as a conveyor line 110*b*. As shown in FIG. 11B, a conveyor pitch d1 of the conveyor line 110*a* and a conveyor pitch d2 of the conveyor line 110*b* are different from each other. The conveyor pitch d2 of the conveyor line 110*b* is shorter than the conveyor pitch d1 of the conveyor line 110*a*. The direction conversion portion 135 has two arms 135*a* (depending on the multiplicity of processing of the spout-equipped bag 1). The spout-equipped bag 1 is picked up from the conveyor line 110*a* rotated 90 degrees, and transferred to the conveyor line 110*b* by each arm 135*a*.

According to Example 4, it is not necessary to match the conveyor pitch with the width of the spout-equipped bag 1 in the whole way of the conveyor line 110. Therefore, even in the case of processing a wide spout-equipped bag 1, it is possible to construct an apparatus including a shorter conveyor line 110.

Figure 12A:
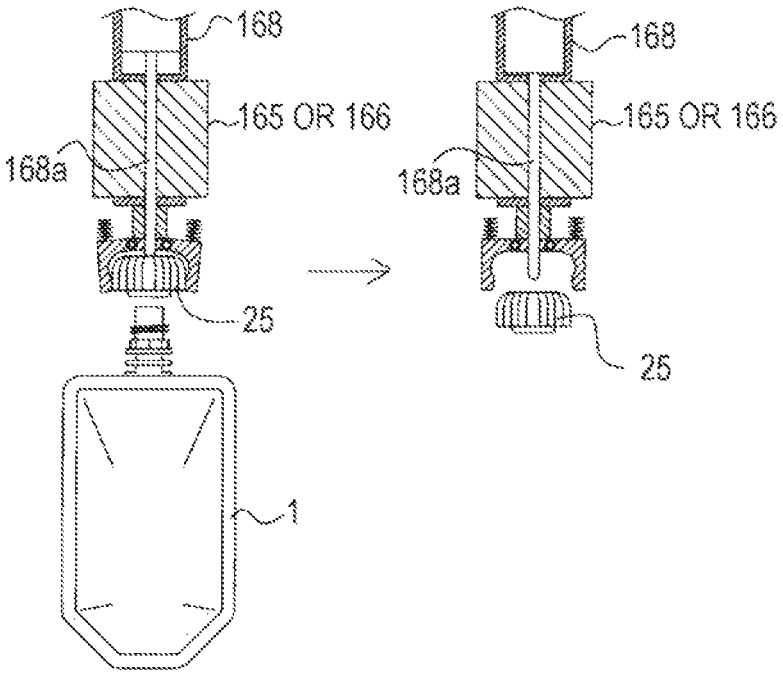
FIGS. 12A and 12B are diagrams showing a mechanism for removing the screw cap from the driver, and each of them shows an example.
Figure 12B:
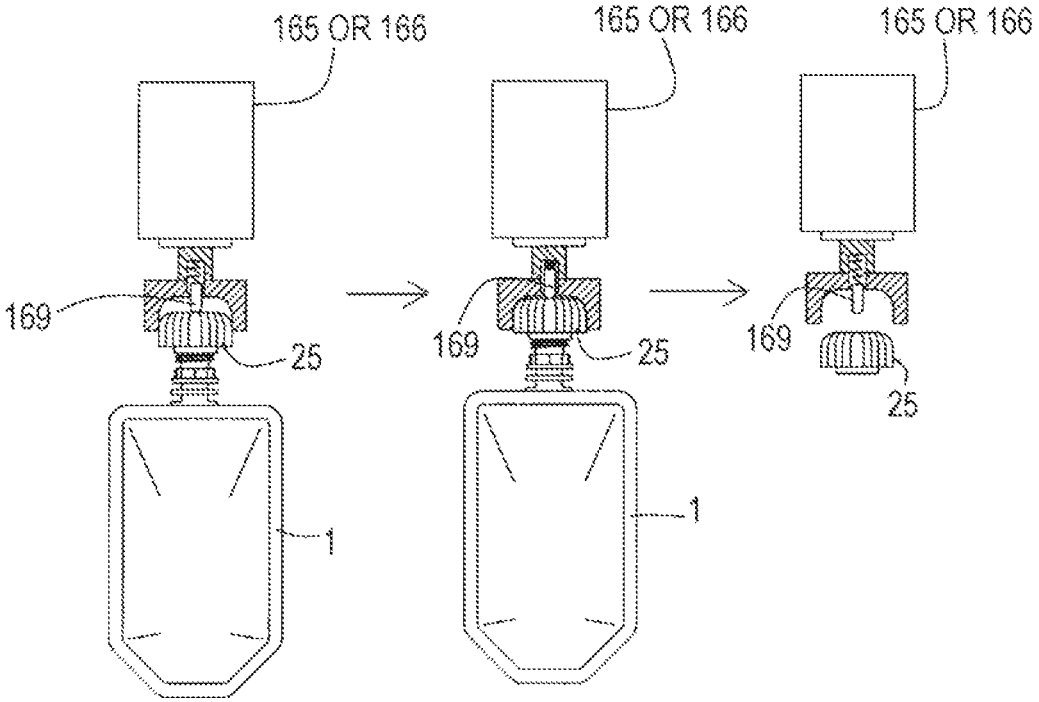

FIGS. 12A and 12B show a mechanism for removing the screw cap 25 from the driver 165 or 166. The screw cap 25 hardly remains in the driver 165 or 166. However, in rare cases, the cap tightening fails, and the screw cap 25 remains in the driver 165 or 166. Then, the cap of the spout-equipped bag 1 cannot be tightened thereafter. As a result, defective products are produced until a manager notices the failure.

As shown in FIG. 12A, the driver 165 or 166 transfers a pressing force by a cylinder 168 provided on a rear side thereof to a top of the screw cap 25 via a push rod 168*a* penetrating an axial center of the driver 165 or 166, to remove the screw cap 25. The push rod 168*a* is retracted at the time of cap tightening and is pushed out when the cap tightening is completed.

As shown in FIG. 12B, a spring rod 169 removes the screw cap 25. The spring rod 169 usually protrudes. However, when the spring rod 169 is pressed against the screw cap 25 by the driver 165 or 166, the spring rod 169 retracts to store a restoring force. When the driver 165 or 166 finishes cap tightening and loses the force pressing the screw cap 25, the restoring force stored in the spring rod 169 is generated. Then, the screw cap 25 is removed.

Figure 13A:
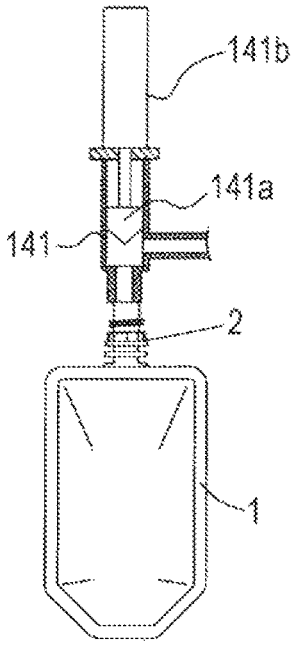
FIGS. 13A and 13B are diagrams showing a mechanism for opening and closing a nozzle, and each of them shows an example.
Figure 13B:
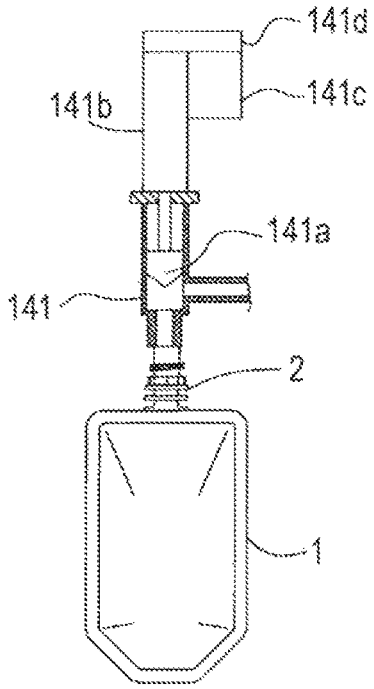

FIGS. 13A and 13B show a mechanism for opening and closing the nozzle 141. Generally, the nozzle 141 opens and closes a valve 141*a* by an air cylinder 141*b*. However, since an opening and closing speed is uneven, it is a problem that a filling amount varies. By using a gear 141*d* for converting a rotational motion of a servomotor 141*c* into a linear motion, it is possible to reduce unevenness in the opening and closing speed.

Figure 14:
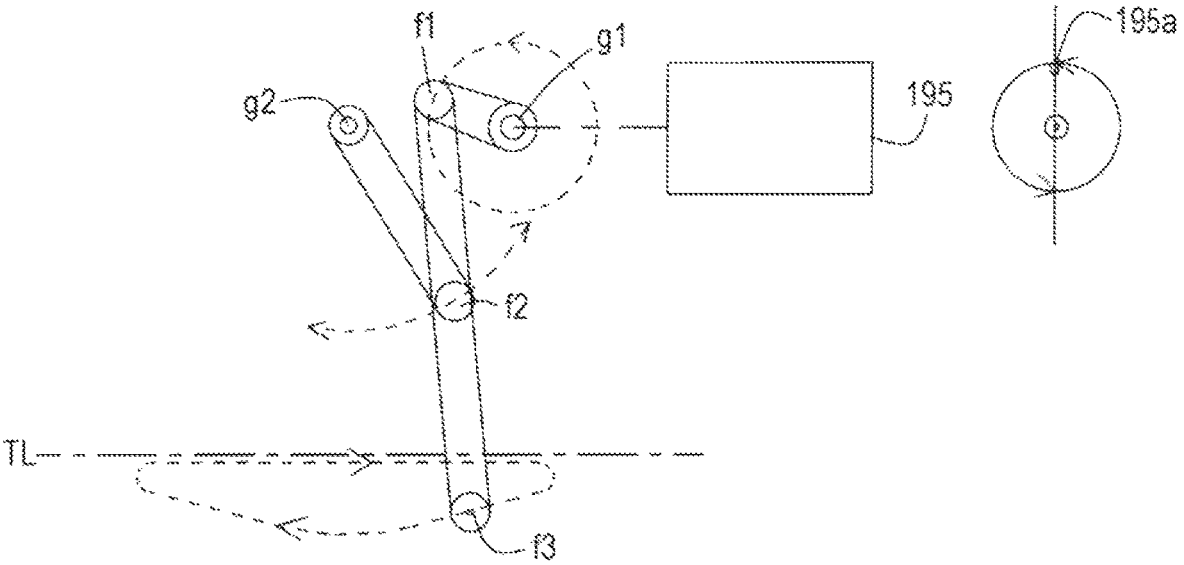
FIG. 14 is a diagram showing an example of a link mechanism for realizing movement of the multi-hook.

FIG. 14 shows an example of a link mechanism for realizing the movement of the multi-hook 111 of the conveyor line 110. The multi-hook 111 departs from the movement straight line after moving by the predetermined distance along the movement straight line TL. Then, the multi-hook 111 bypasses the movement straight line TL and return to the original position along the movement straight line TL. A rotary motor is used as a power source for such movement. However, in general, this mechanism has a constant number of revolutions per unit time. A time required for the multi-hook 111 to move on the movement straight line TL and a time required for the multi-hook 111 to return to the original position after leaving the movement straight line TL have to be the same because the number of revolutions of the rotary motor is constant.

The spout-equipped bag 1 which is heavy and has a low rigidity may be processed in some cases. The multi-hook 111 carries the spout-equipped bag 1 which is heavy and has a low rigidity when moving along the movement straight line TL. Therefore, the multi-hook 111 preferably moves over time in order to suppress the swinging of the bag. On the other hand, when the multi-hook 111 returns, the multi-hook 111 do not carry the spout-equipped bag 1. Therefore, the multi-hook 111 preferably moves in a short time. In the example of FIG. 14, a pulse motor 195 is used as the motor. The pulse motor 195 is provided with a rotational position detection device 195*a*. When the pulse motor 195 reaches the predetermined rotational position, a signal is emitted. The controller (not shown) of the pulse motor 195 changes a frequency of the drive pulse generated per unit time in one revolution. That is, the controller controls the frequencies so that the frequency while the multi-hook 111 departs from the movement straight line TL and returns to the original position is set higher than the frequency while the multi-hook 111 is moving along the movement straight line TL. As a result, it is possible to move the multi-hook 111 slowly when moving along the movement straight line TL and in a short time when returning to the original position. In FIG. 14, g1 and g2 are fixed ends of the link. f1, f2 and f3 are free ends of the link. The pulse motor 195 applies a rotational force to the fixed end g1.

The filling apparatus according to the embodiment of the present disclosure may be any one of the following first to ninth filling apparatuses.

The first filling apparatus includes: the conveyor line for intermittently conveying the spout-equipped bag along the movement straight line by suspending the spout protruding from one side of the flat empty spout-equipped bag on an extension of a plane of the bag so that the bag is positioned on a lower side; the printing apparatus for printing the manufacturing information on the empty spout-equipped bag which is disposed in the middle of the conveyor line and conveyed by the conveyor line; the nozzle for filling the liquid material through the spout into the empty spout-equipped bag which is disposed in the middle of the conveyor line and printed by the printing apparatus; and the driver for sealing with the screw cap the spout of the spout-equipped bag which is disposed in the middle of the conveyor line and filled by the nozzle. The conveyor line conveys the spout-equipped bag in front of the printing apparatus in the width direction of the spout-equipped bag, so that the front of the spout-equipped bag directly faces the printing apparatus.

The second filling apparatus is the first filling apparatus, further including a camera for checking whether the printing has been successfully performed. The conveyor line conveys the spout-equipped bag in front of the camera in the width direction of the spout-equipped bag, so that the front of the spout-equipped bag directly faces the camera.

The third filling apparatus is the first filling apparatus, including the weighing scale for measuring the weight of the spout-equipped bag which is disposed in the middle of the conveyor line and filled with the liquid material. The third filling apparatus corrects the flow rate from the nozzle based on the weight measured by the weighing scale.

The fourth filling apparatus is the first filling apparatus, wherein the conveyor line includes the multi-hook and a large number of holds. The multi-hook has a large number of hooks provided at equal intervals along the movement straight line for suspending the spouts, and moves the spout-equipped bags on the movement straight line by n times (n is a positive integer) the interval between the adjacent hooks in a state in which the spout-equipped bags are suspended so that the width direction of the spout-equipped bags matches the direction of the movement straight line, and then departs from the movement straight line, bypasses the movement straight line, and returns each hook to the original position along the movement straight line. The holds are respectively arranged at the stop positions of the intermittent movement along the movement straight line, and obtain the spouts from the multi-hook, which holds the spouts having moved on the movement straight line, and will depart from the movement straight line.

The fifth filling apparatus is the fourth filling apparatus, wherein the driver for sealing with the screw cap has the driver for pre-tightening the screw cap and the driver for final tightening, and the multi-hook temporarily stops the spout-equipped bag respectively at positions of the driver for pre-tightening and the driver for final tightening.

The sixth filling apparatus is the fifth filling apparatus, having the controller which detects the rotation angle until the mark provided on the screw cap reaches the predetermined rotational position after the torque of the driver performing the final tightening reaches the predetermined value.

The seventh filling apparatus is the first filling apparatus, further including the direction conversion portion, which is between the printing apparatus and the nozzle on the movement straight line of the conveyor line, and converts the conveying direction when conveying the spout-equipped bag, from the width direction of the spout-equipped bag to the thickness direction of the spout-equipped bag.

The eighth filling apparatus includes: the straight conveyor line receiving the empty spout-equipped bags and intermittently conveying the spout-equipped bags; and the printing apparatus directly facing the front of the empty spout-equipped bags conveyed by the conveyor line and printing the manufacturing information. The conveyor line includes: the multi-hook provided with a large number of hooks for suspending the spouts of the spout-equipped bags at equal intervals along the movement straight line, and moving the spout-equipped bags on the movement straight line by n times (n is a positive integer) the interval between the adjacent hooks in a state in which the spout-equipped bags are suspended so that the width direction of the spout-equipped bags matches the direction of the movement straight line, and then departing from the movement straight line, bypassing the movement straight line, and returning each hook to the original position along the movement straight line; the bag supply apparatus for suspending n pieces of spouts in parallel on n pieces of hooks provided continuously at equal intervals; a large number of holds respectively arranged at the stop positions of the intermittent movement along the movement straight line, holding the spouts having moved on the movement straight line, and obtaining the spouts from the multi-hook by separation of the multi-hook; n×m (m is a positive integer) pieces of transfer rails provided corresponding to n×m pieces of holds continuously provided; and the delivery device provided corresponding to the n×m pieces of holds, and delivering the spout-equipped bags obtained by the n×m pieces of the holds to the transfer rails when the multi-hook intermittently moves m times. The nozzles for filling the spout-equipped bags are respectively provided corresponding to the transfer rails.

The ninth filling apparatus includes: the straight conveyor line receiving the empty spout-equipped bags and intermittently conveying the spout-equipped bags; and the printing apparatus directly facing the front of the empty spout-equipped bags conveyed by the conveyor line and printing the manufacturing information. The conveyor line includes: a first multi-hook provided with a large number of hooks for suspending the spouts of the spout-equipped bags at equal intervals along a first movement straight line, and moving the spout-equipped bags on the first movement straight line by n times (n is a positive integer) the interval between the adjacent hooks in a state in which the spout-equipped bags are suspended so that the width direction of the spout-equipped bags matches the direction of the first movement straight line, and then departing from the first movement straight line, bypassing the first movement straight line, and returning each hook to the original position along the first movement straight line; a second multi-hook provided with a large number of hooks for suspending the spouts of the spout-equipped bags at equal intervals along a second movement straight line, and moving the spout-equipped bags on the second movement straight line by n times the interval between the adjacent hooks in a state in which the spout-equipped bags are suspended so that the width direction of the spout-equipped bags matches the direction of the second movement straight line, and then departing from the second movement straight line, bypassing the second movement straight line, and returning each hook to the original position along the second movement straight line; a third multi-hook provided with a large number of hooks for suspending the spouts of the spout-equipped bags at equal intervals along a third movement straight line, and moving the spout-equipped bags on the third movement straight line by 2×n times the interval between the adjacent hooks in a state in which the spout-equipped bags are suspended so that the width direction of the spout-equipped bags matches the direction of the third movement straight line, and then departing from the third movement straight line, bypassing the third movement straight line, and returning each hook to the original position along the third movement straight line; and a large number of holds respectively arranged at the stop positions of the intermittent movement along the first, the second and the third movement straight lines, holding the spouts having moved on the first, the second and the third movement straight lines, and obtaining the spouts from each multi-hook by separation of the first and second multi-hooks. The first movement straight line is on an extension of the third movement straight line, and the first multi-hook holds the spouts from the first n pieces of consecutive holds at the time of return, with respect to 2×n pieces of holds which are continuously provided and obtain the spouts from the third multi-hook. Further, the ninth filling apparatus includes: n pieces of transfer rails corresponding to the remaining n pieces of holds out of the 2×n pieces of holds; and the delivery device for delivering the spout-equipped bags obtained in the n pieces of holds to the transfer rail. The second multi-hook holds the spouts from the transfer rail at the time of return, and further there are provided the nozzles for filling the spout-equipped bags respectively corresponding to the first and second movement straight lines.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A filling apparatus for filling a liquid material into spout-equipped bags each comprising a bag and a spout protruding from one side of the bag, the filling apparatus comprising:

a conveyor line configured to intermittently convey the spout-equipped bags on a movement straight line in a state that the spout-equipped bags are suspended so that the spouts are located on an upper side and the bags are located on a lower side;

a printing apparatus disposed in a first portion of the conveyor line and configured to print manufacturing information on the suspended spout-equipped bags; and nozzles arranged in a second portion of the conveyor line and configured to fill the suspended spout-equipped bags with the liquid material through the spouts, wherein the conveyor line is further configured to convey the spout-equipped bags so that fronts of the spout-equipped bags directly face the printing apparatus, the spout-equipped bags are flat before the liquid material is filled and expand in a thickness direction by being filled with the liquid material, a width direction of the suspended spout-equipped bags is perpendicular to a protruding direction of the spouts and the thickness direction, at least the movement straight line of the first portion of the conveyor line is parallel to the width direction, the conveyor line comprises:

a multi-hook comprising a straight main body and a plurality of hooks provided at equal intervals along a longitudinal side of the straight main body, the multi-hook being configured to move along the movement straight line by a distance by which the spout-equipped bags are intermittently conveyed, thereafter, depart from the movement straight line, bypass the movement straight line and then return to an original position along the movement straight line; and a pair of hold bars provided parallel to a direction of the longitudinal side of the straight main body and vertically displaced from the multi-hook, the pair of hold bars being configured to sandwich the spout-equipped bags by narrowing an interval between the pair of hold bars and release the spout-equipped bags by opening the interval between the pair of hold bars, and the spout-equipped bags are intermittently conveyed along the movement straight line by the following operations:

the multi-hook moves along the movement straight line while the spout-equipped bags are suspended by the plurality of hooks and released from the pair of hold bars;

when the spout-equipped bags stop in the intermittent movement, the pair of hold bars narrow the interval between the pair of hold bars to sandwich the spout-equipped bags, then the multi-hook departs from the movement straight line; and then the multi-hook bypasses the movement straight line and then returns to the original position along the movement straight line while the pair of hold bars sandwich the spout-equipped bags.

2. The filling apparatus according to claim 1, further comprising drivers configured to seal with screw caps the spouts of the filled spout-equipped bags.

3. The filling apparatus according to claim 2, wherein the driver comprises a first driver for pre-tightening the screw cap, and a second driver for final tightening, and the multi-hook is configured to stop the spout-equipped bag at a position in which the first driver is disposed and a position in which the second driver is disposed.

4. The filling apparatus according to claim 3, further comprising a controller configured to detect a rotation angle until a mark provided on the screw cap reaches a predetermined rotational position after torque of the second driver reaches a predetermined value.

5. The filling apparatus according to claim 1, further comprising a camera to check whether printing is normally performed, wherein the conveyor line is configured to convey the spout-equipped bags so that the fronts of the spout-equipped bags directly face the camera.

6. The filling apparatus according to claim 1, further comprising a weighing scale measuring weights of the spout-equipped bags filled with the liquid material, wherein the filling apparatus is configured to correct a flow rate of the liquid material from the nozzle based on the weight measured by the weighing scale.

7. The filling apparatus according to claim 1, wherein the multi-hook is configured to intermittently convey the spout-equipped bags suspended by the hooks by a distance n times of the interval, depart from the movement straight line after the spout-equipped bags suspended by the hooks are intermittently conveyed by the distance n times of the interval, bypass the movement straight line, and then return to the original position along the movement straight line, the n is a positive integer, and holds provided on the hold bars are respectively arranged at positions in which the intermittently conveyed spout-equipped bags stop, and are configured to obtain the spout-equipped bags from the multi-hook holding the stopping spout-equipped bags prior to the multi-hook departing from the movement straight line.

8. The filling apparatus according to claim 7, wherein the conveyor line comprises n×m pieces of the holds, n×m pieces of transfer rails, and delivery devices, the m is a positive integer and a number of an intermittent conveyance of the spout-equipped bags by the conveyor line, the transfer rails are arranged at positions corresponding to the holds, the delivery device is configured to deliver the spout-equipped bags obtained by the n×m pieces of holds to the n×m pieces of transfer rails after the spout-equipped bags suspended by the multi-hook are intermittently conveyed m times, and the nozzles are arranged at positions corresponding to the n×m pieces of transfer rails.

9. The filling apparatus according to claim 7, wherein the spout has three radially extending flanges including an uppermost flange, a middle flange and a lowermost flange, the multi-hook fits onto an upper neck formed between the uppermost flange and the middle flange, and the hold bars fit onto a lower neck provided between the middle flange and the lowermost flange.

10. The filling apparatus according to claim 1, further comprising a direction conversion portion disposed between the printing apparatus and the nozzle and configured to convert a direction of the movement straight line from a direction parallel to the width direction of the spout-equipped bag to a direction parallel to the thickness direction of the spout-equipped bag.

11. The filling apparatus according to claim 1, wherein the bag of the spout-equipped bag is formed by a gusset film folded inward from both sides of a front and back pair of exterior films.

12. The filling apparatus according to claim 1, further comprising:

drivers configured to seal with screw caps the spouts of the filled spout-equipped bags; and a weighing scale measuring weights of the spout-equipped bags filled with the liquid material, wherein the conveyor line is configured to convey the spout-equipped bags in front of the printing apparatus, the nozzles, the drivers and the weighing scale in the width direction so that the fronts of the spout-equipped bags directly face the printing apparatus and the weighing scale.

* * * * *